US008193918B1

(12) United States Patent
Shavelsky et al.

(10) Patent No.: US 8,193,918 B1
(45) Date of Patent: Jun. 5, 2012

(54) INTERACTIVE MEDICATION DISPENSING SYSTEM

(75) Inventors: Eran Shavelsky, Newton, MA (US); Woodie C. Flowers, Weston, MA (US); Justin F. Aiello, Kennebunk, ME (US)

(73) Assignee: MedMinder Systems, Inc., Newton, MA (US)

( * ) Notice: Subject to any disclaimer, the term of this patent is extended or adjusted under 35 U.S.C. 154(b) by 287 days.

(21) Appl. No.: 12/606,643

(22) Filed: Oct. 27, 2009

Related U.S. Application Data

(60) Provisional application No. 61/197,859, filed on Oct. 31, 2008.

(51) Int. Cl.
*G08B 1/00* (2006.01)

(52) U.S. Cl. ..... 340/309.16; 340/572.1; 340/573.1; 368/10; 700/242; 700/236; 700/241; 700/244

(58) Field of Classification Search ..... 340/572.1, 340/309.1, 573.1; 368/10; 700/242, 236, 700/241, 244
See application file for complete search history.

(56) References Cited

U.S. PATENT DOCUMENTS

| | | | | |
|---|---|---|---|---|
| 3,369,697 | A * | 2/1968 | Glucksman et al. | 221/9 |
| 4,693,371 | A | 9/1987 | Malpass | |
| 5,564,593 | A * | 10/1996 | East, Sr. | 221/3 |
| 5,710,551 | A | 1/1998 | Ridgeway | |
| 5,852,590 | A * | 12/1998 | de la Huerga | 368/10 |
| 5,954,225 | A | 9/1999 | Powe | |
| 6,259,654 | B1 * | 7/2001 | de la Huerga | 368/10 |
| 6,457,611 | B1 | 10/2002 | Koehler | |
| 6,529,446 | B1 * | 3/2003 | de la Huerga | 368/10 |
| 7,369,919 | B2 | 5/2008 | Vonk et al. | |
| 2003/0099158 | A1 * | 5/2003 | De la Huerga | 368/10 |
| 2008/0164272 | A1 | 7/2008 | Dallman | |

OTHER PUBLICATIONS

O'Connor, "Improving Medication Adherence: Challenges for Physicians, Payers, and Policy Makers", Sep. 25, 2006, pp. 1802-1804, vol. 166, No. 17, Published in: US.

HarrisInteractive, "Prescription Drug Compliance A Significant Challenge for Many Patients, According to New National Survey", Mar. 29, 2005, Publisher: HarrisInteractive, Published in: US.

Col, et al., "The Role of Medication Noncompliance and Adverse Drug Reactions in Hospitalizations of the Elderly", Apr. 1990, pp. 841-845, vol. 150, No. 4, Publisher: Archives of Internal Medicine, Published in: US.

* cited by examiner

*Primary Examiner* — Daryl Pope
(74) *Attorney, Agent, or Firm* — William A. Loginov, Esq.; Loginov & Associates, PLLC

(57) ABSTRACT

This invention provides a medication dispensing system that instructs the user through visual and audio cues, such as the illumination of individual medication cups that are arrayed in accordance with a daily and weekly schedule in separate orifices within the dispenser body. The system and method monitors compliance by determining when an indicated cup is accessed, based upon at least one of manipulating a lid and/or placing into, removing from, or replacing into the correct orifice based upon the indication. The cups can be refilled at an appropriate time based upon an indication by the system, and/or can be provided in removable refill tray (that is prefilled by a pharmacist) which simplifies the refill process. The dispenser can include an on-board processor that stores a current configuration including the treatment schedule. The configuration can be programmed/re-programmed, and compliance can be monitored, via a wired or wireless server connection that communicates with interested parties (e.g., the user, family, caregivers, physicians and the like), and that supports a graphical user (web-based) interface. The server allows interested parties to generate reports regarding compliance. The server also transmits alerts to interested parties via a variety of communications mechanisms (telephone, e-mail, text-messaging (SMS), etc.) in cases of current or continuing non-compliance by the user/patient.

19 Claims, 20 Drawing Sheets

INTERACTIVE MEDICATION DISPENSING SYSTEM

RELATED APPLICATION

The present application claims the benefit of copending U.S. Provisional Application Ser. No. 61/197,859, entitled Interactive Medication Dispensing System, by Eran Shavelsky, Woodie C. Flowers, Justin Aiello, filed Oct. 31, 2008, the teachings of which are expressly incorporated herein by reference.

FIELD OF THE INVENTION

This invention relates to systems and methods for ensuring compliance by a patient in taking scheduled medications.

BACKGROUND OF THE INVENTION

Poor adherence to medication schedules is a recognized medical problem, costing an estimated $100 billion a year (Improving Medication Adherence, Archives of Internal Medicine 2006, 166:1802-1804). Failing to comply with pharmacological therapies leads to over approximately 125,000 deaths in the US each year, twice the number of people killed in automobile accidents (http://www.harrisinteractive-.com/news/allnewsbydate.asp?NewsID=904). Almost 30% of all hospital admissions for people over the age of 65 are directly attributable to medication non-compliance (Archives of Internal Medicine 1990; 150: 841-845). Nearly $48 billion in annual costs result from unnecessary medication-induced hospitalization (Archives of Internal Medicine—October 1995). Approximately 40% of people entering nursing homes do so because they are unable to self-medicate in their own homes (Feasibility Study, Biomedical Business International, January 1988). About one-half of the 1.8 billion prescriptions dispensed annually are not taken correctly, contributing to prolonged or additional illnesses (Medications and the Elderly, Ch. 4 pp 67-68, 75).

Care management and Health Plans currently rely on labor-intensive and costly intervention programs to improve medication compliance. Directly Observed Therapy (DOT) programs employ a health care worker to directly administer, observe and document a patient's ingestion of a medication.

Patients who must take medication in pill form often use a multi-compartment pillbox to help organize the task of taking the proper medication at the proper time. Patients who must take many pills per day at different times of the day frequently use a daily manual pillbox that has four compartments for one day. These compartments are designated AM, NOON, PM, Bed, or Breakfast, Lunch, Dinner, Bed, or some other set of designations, for instance, by time. The four compartments may be integral, or may be individual small boxes that are retained in a day-frame, so that each can be individually manipulated. Pill organizers typically may have seven of such daily four compartment boxes, arranged according to the seven days of the week. Such weekly organizers may typically include a frame that removably retains each of seven daily pillboxes, so that each one can be individually removed and manipulated. Rather than four compartments, a daily system may have more or less compartments, depending on the complexity of the patient's medication regime.

Such manual medication systems are simple, and have both advantages and disadvantages. The advantages include that they are inexpensive and relatively easy to set up and use. A patient or a patient's aid determines which medications are required for each day, and the times of the day that they are required. The required pills are placed into the corresponding compartments, the compartments are closed and each day-set is put into the week-frame for safe-keeping. The patient or the patient's aid opens the appropriate compartment at the appointed times, removes the medication, and the patient consumes it. It is refilled with the proper medications at some time before the next day or week when the compartment or day-set is required to be used again and the process begins again. Other advantages are that the day-set or week-frame can be relatively easily transported to accompany the patient if the patient needs to be away from home for a day or more. They can be cleaned relatively easily. They are arranged physically in a manner that mimics a daily organizer, such as a calendar or a day-planner, and thus, are not confusing, typically, as to which medication has been designated to be taken at which time(s).

Medication organizing equipment as described above does have disadvantages. Some disadvantages relate to loading the medications into the equipment, and some relate to removing the medications. Further, these manual systems provide only rudimentary record keeping functions. Turning first to the loading disadvantages, many patients are on complicated medication regimes, and thus, it may be complicated to ensure that the correct medication is placed in the compartment that corresponds to the correct time to take that medication. Duplicate pill placement may take place, which could result in an overdose. Or, a placement may be inadvertently omitted, which might result in an under dose. Some patients may find it psychologically daunting to face the task of organizing all of the medications. Or they may simply be unable to do so cognitively, especially if their condition affects their cognition.

Turning to the dispensing disadvantages, a typical day-set contains four compartments, and a typical week-set contains seven day-sets, for a total of twenty-eight dose medication compartments. A patient might become confused as to which medication compartment to use at any given time. Even if not confused, a patient might open a medication compartment from the correct day, but the wrong time, or, perhaps, the correct time, but from the wrong day of the week (for instance, regarding a medication that is taken only every other day, or for three consecutive days, but not the following four). A patient may forget to take any medication at a prescribed time, may open a wrong compartment or may simply not take the medication for another reason. Additionally, a patient might forget that they have taken a given dose of medication, and might take an additional dose. If two people share responsibility for a patient, including, perhaps, the patient himself/herself, both people might give the patient a dose of the same medication, erroneously, resulting in an overdose.

Further disadvantages relate to the lack of real time remote visibility for caregivers or third parties to monitor compliance with the medication schedule. It is also beneficial to generate accurate records reflecting when medication has been taken, or accessed, and what medication has been taken.

In recent years, automated and semi-automated systems have been developed. Many of these systems have disadvantages of their own. They typically have many and complicated features. The user interfaces are overly complicated, and include multiple data read-outs and opportunities for input, similar in complexity to video recording equipment, or kitchen appliances, many of which remain un-programmed, with some features unused. Such systems intimidate and confuse many users, particularly elderly and infirm who require significant amount of medication at specific times. Ironically, the more one is in need of the system, due to the complexity of their drug regime, the greater the probability that they might be unable to use such a modern system. They are difficult to set-up and to program the drug regime. They are sometimes also difficult to use for dispensing medication, because of complex user interaction controls.

It is therefore desirable to provide a medication dispensing apparatus and system that is straightforward and simple to load with medication. There is also need for such a system from which it is straightforward and simple to dispense medication in proper doses at the proper times. This medication apparatus and system should identify which of many individual dose medication compartments should be used at a given time. It is further desirable that the medical apparatus and system should remind a user that it is time to take medication, and, continue to remind the user until the medication is taken. There is a further need for a system to remind patients to take their medication through various auditory, visual and other cues, and that notifies a third party if the patient does not take the medication or takes the wrong set of medication for a given time period. It is desirable that such a system notifies third parties who are in the same location as the patient, as well as at a distant location if the patient fails to take the required medication. It is desirable that an apparatus in which all of the dose compartments for an entire week, or other long-range time period can be opened and closed together as a group and easily refilled. It is desirable that such a system have a simple user interface, without the need to read text or interpret complex light or sound codes, and that presents minimal or no risk of accidental reprogramming after set-up, and whose setup can be remotely changed in a real-time manner. Lastly, it is desirable that such a system provides flexible real time and periodic compliance and non-compliance reporting, and integrates with external medical health record keeping systems.

SUMMARY OF THE INVENTION

This invention overcomes the disadvantages of the prior art by providing a medication dispensing system and method that is straightforward to use, and provides clear indications of the user's (patient's) compliance with a pre-programmed treatment schedule. The dispenser instructs the user through visual and audio cues, such as the illumination of individual medication cups that are arrayed in accordance with a daily and weekly schedule in separate orifices within the dispenser body. The system and method monitors compliance by determining when an indicated cup is at least one of placed into, removed therefrom or replaced thereinto the correct orifice based upon the indication. The cups can be refilled at an appropriate time based upon an indication by the system, and/or can be provided in removable refill tray (that is pre-filled by a pharmacist) which simplifies the refill process. The dispenser can include an on-board processor that stores a current configuration including the treatment schedule. The configuration can be programmed/re-programmed, and compliance can be monitored, via a wired or wireless server connection that communicates with interested parties (e.g., the user, family, caregivers, physicians and the like), and that supports a graphical user (web-based) interface. The server allows interested parties to generate reports regarding compliance. The server also transmits alerts to interested parties via a variety of communications mechanisms (telephone, e-mail, text-messaging, etc.) in cases of current or continuing non-compliance by the user/patient.

In an illustrative embodiment, the medication dispensing system and method provides a dispenser body having a top housing having a plurality of orifices each constructed and arranged to respectively receive each of a plurality of cups, sized and arranged to store medication therein, and a sensor at each of the orifices that detects when a respective one of the cups is accessed. Such access can include (a) opening or closing (or other lid-movement from one predetermined orientation to another predetermined orientation) a movable compartment lid overlying a respective cup, (b) using a presence sensor (capacitive, heat, radar, etc.) to detect a user's finger in proximity to a cup, and/or (c) at least one of placing into, removing therefrom or replacing a cup into a respective orifice within the body. A processor monitors access of each of the cups, correlates the monitored state of at least one of placement, removal and replacement of each of the cups (or otherwise placing or removing of medication in the respective cup) with a pre-programmed schedule, and provides, in response to the correlation, a signal indicative of the monitored state relative to a pre-programmed schedule. The signal to the user can be at least one of an operation of a light, transmission of a sound, generation of a cue, or transmission of predetermined information with respect to the monitored state to a remote server. The orifices can be arranged with respect to days and times of day. The cups can be translucent to guide light therethrough, and the cups can be selectively covered by a translucent, moveable cup lid. An illuminated reminder indicator responsive to the signal can include a plurality of lights in which each of the lights is located with respect to each of the plurality of cups. Where the cup and cup lid are translucent, an illuminated reminder indicator responsive to the signal can be located beneath or around the cup so as to transmit light into and through the cup. The moveable translucent lid can also be constructed so as to transmit light into and through the lid. The processor can be housed in the body and can be operatively connected, either wired or wirelessly, to a remote server constructed and arranged to enable programming and reprogramming of the configuration. The processor can monitor the user's removal of discrete cups by the user and generate compliance data by determining the user's access of each of the cups (for example, by opening or closing a compartment lid, presence-sensing, or placing, removing or replacing) at scheduled times according to a predetermined medication schedule and reports the compliance data to a central server for access by an interested party. The body can also include a hinged bezel door that selectively covers each of the cups and wherein the remote server is constructed and arranged to report to a recipient information related to the opening and closing of the bezel door. The remote server is constructed and arranged to report to the recipient information related to at least one of (a) removal of each of the cups with respect to the configuration, (b) replacement of each of the cups with respect to the configuration, (c) refilling of a plurality of the cups with respect to the configuration, (d) replacement of an entire tray with respect to the configuration. Moreover, the processor can be constructed and arranged to operate in accordance with a recent programmed configuration upon a disconnection from the remote server. Additionally, the processor can monitor the removal and replacement of the each of the cups so as to determine a requirement for refill of medication into the cups, and generates a refill reminder signal.

According to a further embodiment, a system and method of refilling a medication dispensing system includes providing a plurality of cups that are sized and arranged to store medication therein, and loading medication into each of the cups according to a predetermined medication schedule, loading the cups into a body of the medication dispensing system, wherein the body includes a plurality of orifices that each respectively receive each of the medication cups and senses removal or return of the respective cups. Illustratively, the step of refilling the medication dispensing system can include (a) providing a refillable tray, (b) loading medication into the cups, the cups being mounted into the refillable tray according to a predetermined medication schedule, (c) providing the tray filled with the medication to the user for installation into the body of the medication dispensing system, and (d) loading the refillable tray into the body of the medication dispensing system, in a predetermined alignment with respect to the body of the dispensing system. The step of providing the tray filled with the medication to the user can include opening a hinged bezel door of the body, applying a removable cover that maintains the cups with the tray and the medication within each of the respective cups during storage and handling of the tray, and closing the bezel door to secure the cups within the body. Illustratively, the processor monitors the user's removal of discrete cups by the user and generates compliance data by determining the user's removal of each of the cups at scheduled times according to a predetermined medication schedule and reports the compliance data to a central server for access by an interested party. Illustratively, the processor monitors the access of each of the cups including opening or closing a lid and/or at least one of the placement, removal and replacement of the each of the cups so as to determine a requirement for refill of medication into the cups, and generates a refill reminder signal.

BRIEF DESCRIPTION OF THE DRAWINGS

The invention description below refers to the accompanying drawings, of which:

FIG. 1A shows a closed view of an illustrative embodiment in the form of a pillbox;

FIG. 1B shows an open view of the pillbox that illustrates the compartments within;

FIG. 1C illustrates the power supply options for the pillbox;

FIG. 1D is a perspective view of a pillbox with the bezel door open, and medication pills residing in some medication cups, one of which has been removed and set aside for illustration purposes; and FIG. 1E is a perspective view showing a pillbox with the bezel open, and no cups or tray in place, showing empty compartments and LEDs, as well as detection sensors, in the bottoms thereof;

FIG. 1F shows a closed view of the pillbox where the bezel door is closed, but individual compartments are open.

FIG. 2A illustrates a disposable pre-fillable medication tray as an aspect of a refill option; and FIG. 2B depicts a medication tray placed in the illustrative embodiment of the apparatus illustrated in FIG. 1B.

FIG. 3A illustrates in an exploded view each component of an embodiment of a pillbox hereof, having cups for receiving medication;

FIG. 3B illustrates the door detail of medication compartments; and

FIG. 3C is a perspective view of a medication tray having cups equipped with a removable cover.

FIG. 5A depicts the overall workflow;

FIG. 5B depicts an illustrative embodiment of a workflow of setting up the apparatus;

FIG. 5C is an illustrative embodiment of the workflow of a reminder system for the apparatus;

FIG. 5D is an illustrative embodiment of the workflow of a refill system for the apparatus.

FIGS. 7A-7C depicts an illustrative embodiment of the managing application, wherein:

FIG. 7A depicts a schedule and preference filling interface of an illustrative embodiment of the managing application;

FIG. 7B depicts a medication management interface of an illustrative embodiment of the managing application;

FIG. 7C depicts a caregiver interface of an illustrative embodiment of the managing application;

DETAILED DESCRIPTION

Figure 1A:
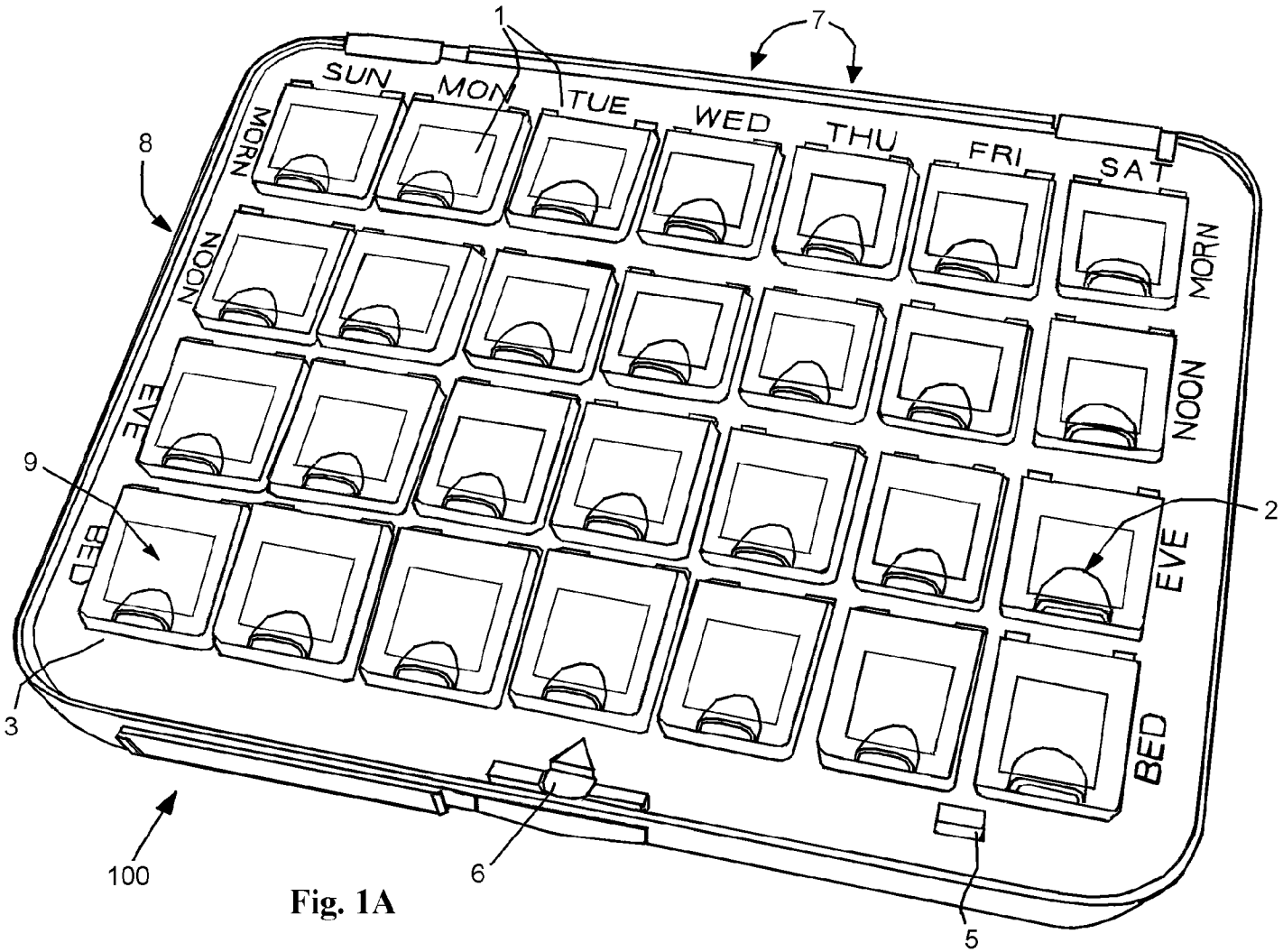
FIGS. 1A-1F show, schematically, an illustrative embodiment of a medication dispensing unit of an apparatus invention hereof. The medication dispensing unit can also be referred to herein as a "unit" or a "pillbox" where.

FIG. 1A shows a medication dispensing system 100 according to an illustrative embodiment of the invention. The medication dispensing system (also termed a "pillbox") 100 includes one or more medication "compartments" 1. The compartments 1 are set and arranged in a removable tray 15. The compartment 1 is covered by a lid 2, which is opened using the handle 3. As used herein and described more fully below, the term "compartments" refers collectively to a cup, a moveable lid covering the cup and an orifice within the body in which the cup resides. The moveable lid 2 can be furnished with a variety of movement devices, included a hinge assembly. As used herein and described more fully below, the term "orifice" refers to an individual well that is designed to hold a single removable cup. Each compartment is constructed and arranged to allow removal and replacement of the respective cup in order for a user to access the medication contained therein. The cups are designed to contain medication doses of a predetermined maximum size. The transparency or semi-transparency of the lid 2 lends to easy medication identification and visual cue viewing. The compartments can be arranged in column sets 7 and in row sets 8. The pillbox status is indicated by a status Light-emitting diode ("LED") 5. LED 5 has several status functions, including changing colors or flashing lights. Medication dose integrity and security is maintained by a latch 6 that ensures that the medication in the individual compartments 1 does not fall out. The LED 5 is placed below or around the compartments 1 so as to indicate the proximal medication. The top of the pillbox 100 is provided with indicia 70 that correlate to the column sets 7 and row sets 8. The exemplary indicia 70, as depicted in FIG. 1A, correspond to days of the week for the column sets 7 and periods of the day for the row sets 8. The indicia can alternatively be provided in other units of time, such as dates and hours.

Figure 1B:
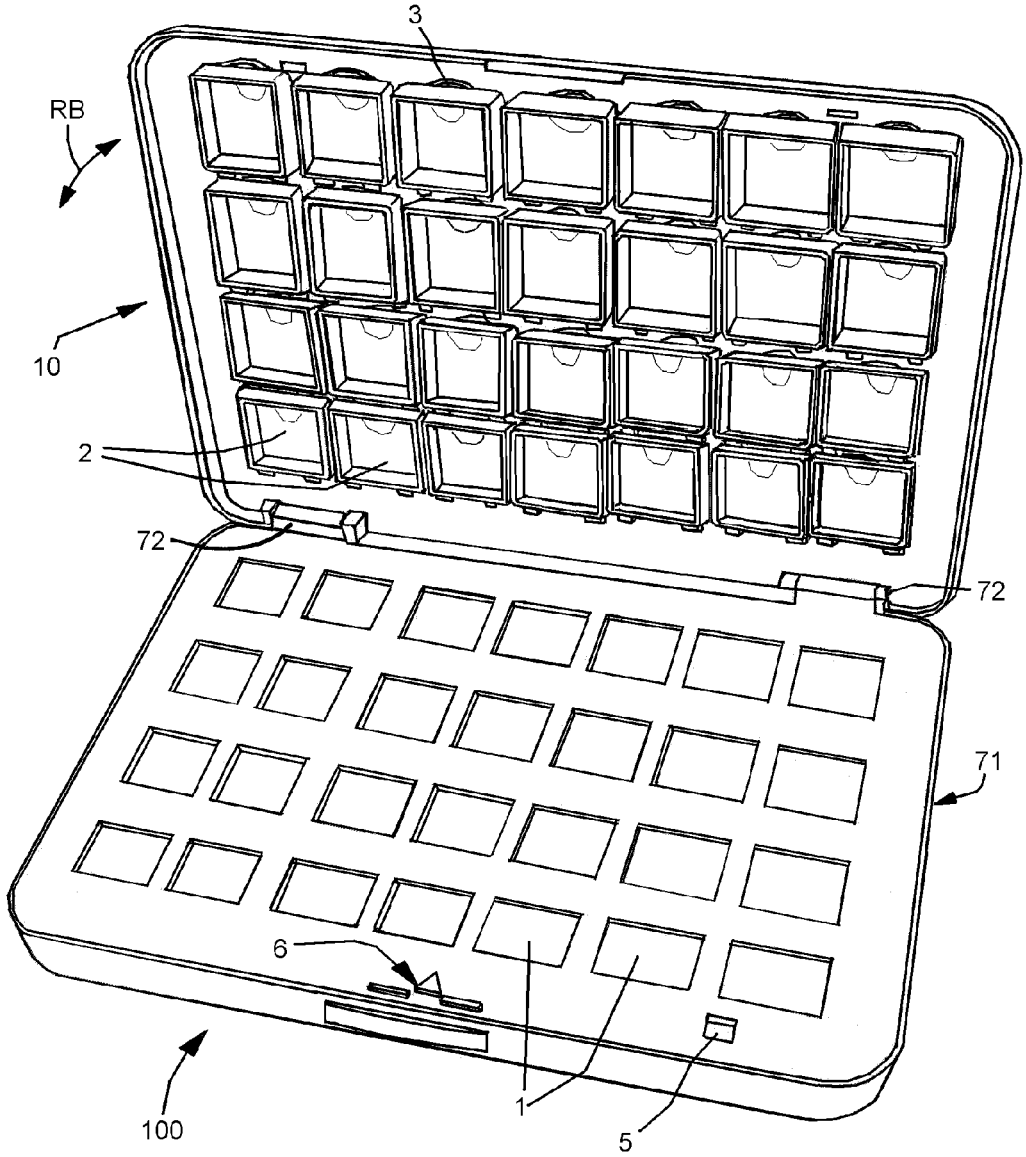

As further shown in FIG. 1B, pillbox 100 has a bezel door assembly 10 which functions as an extended protective covering for the compartments 1. The bezel door assembly 10 allows for the utilization of a removable pharmacy pack or for group treatment of the compartments, thus allowing for easy refill, as discussed below, in connection with FIG. 2B. The bezel door assembly 10 is composed of a durable, lightweight material, such as a polymer or lightweight metal and is joined with the main pillbox body 71 at hinges 72. The hinges 72 permit the bezel door assembly 10 to be rotated axially RB from a closed position, to a flattened open position. The hinges 72 have sufficient friction so as to be able to hold the bezel door assembly 10 in the perpendicular position depicted in FIG. 1B. Alternatively, the hinges 72 can be pressed or clipped to the pillbox 100, attached with removable connectors or by another mechanism that serves to allow opening of the bezel door 5 and secure attachment to the pillbox 100.

It is noted that opening and closing the bezel door assembly 10 actuates an appropriate sensor within the bezel door (not shown) that causes a report to be sent from the pillbox's central processor to the remote central server (not shown in FIG. 1B, but shown and described more fully below). Each opening and closing of the bezel door assembly is a discrete event that is recorded in the central server database and changes the state of the system. This feature is advantageous in directing the user to initiate a refill of the cups, either with or without the refilling of the tray 15. The detection of the movement of the bezel door assembly also advantageously provides general information about the activity of the opening and closing of the pillbox.

Figure 1C:
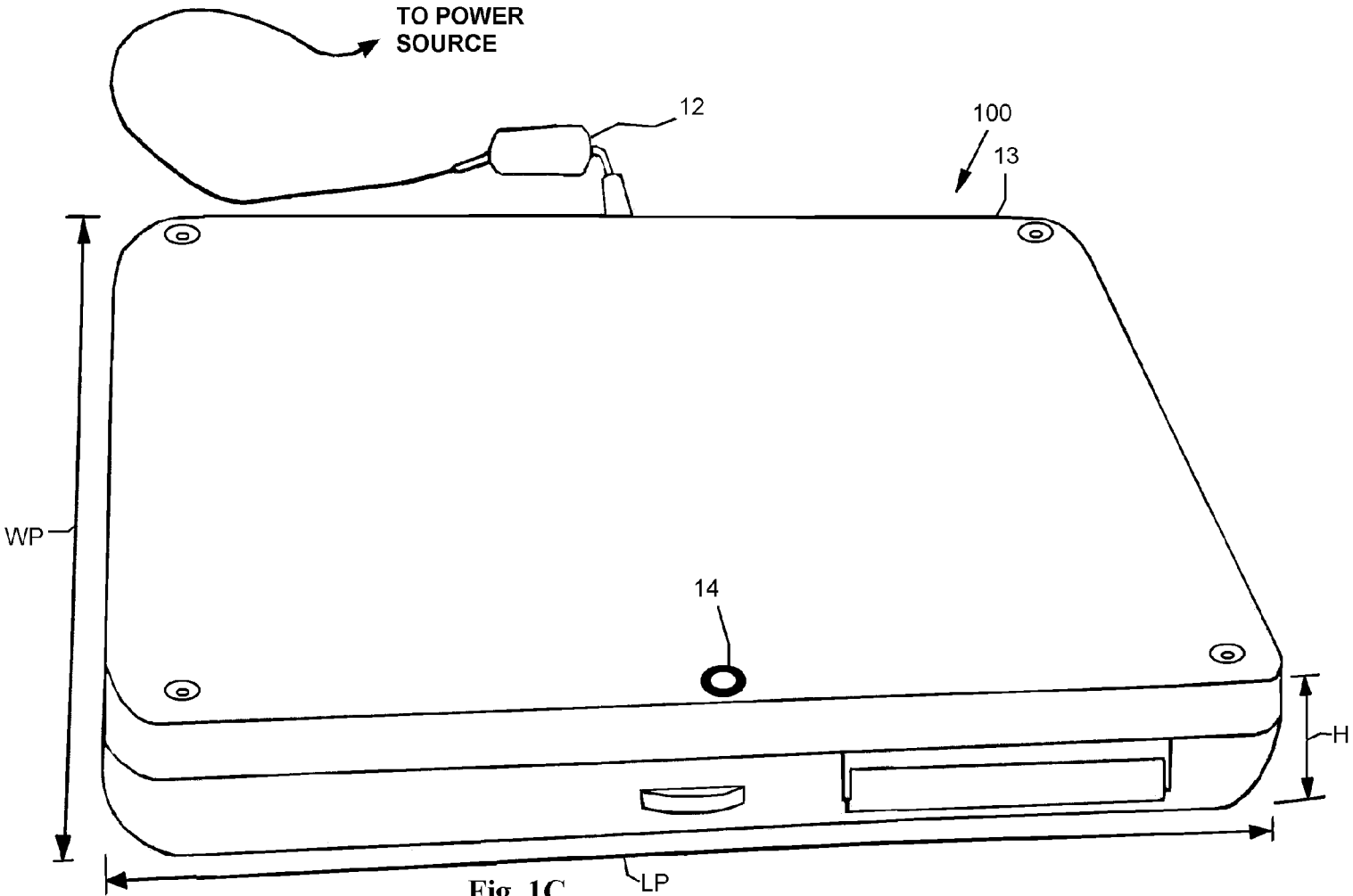

FIG. 1C shows the power options, according to an illustrative embodiment. The pillbox 100 is provided with an Alternating Current ("AC") power adapter 12 and a Direct Current ("DC") back-up battery 13 which allows the unit to function independently. The speaker 14 allows the unit to provide the user with auditory cues. The pillbox 100 contains a compact integral central processor and circuitry (not shown). The pillbox 100 is depicted in a closed configuration and has a length LP of approximately 12 to 24 inches, a height HP of approximately 1.5 to 4 inches and a width WP of approximately 6 to 12 inches.

Figure 1E:
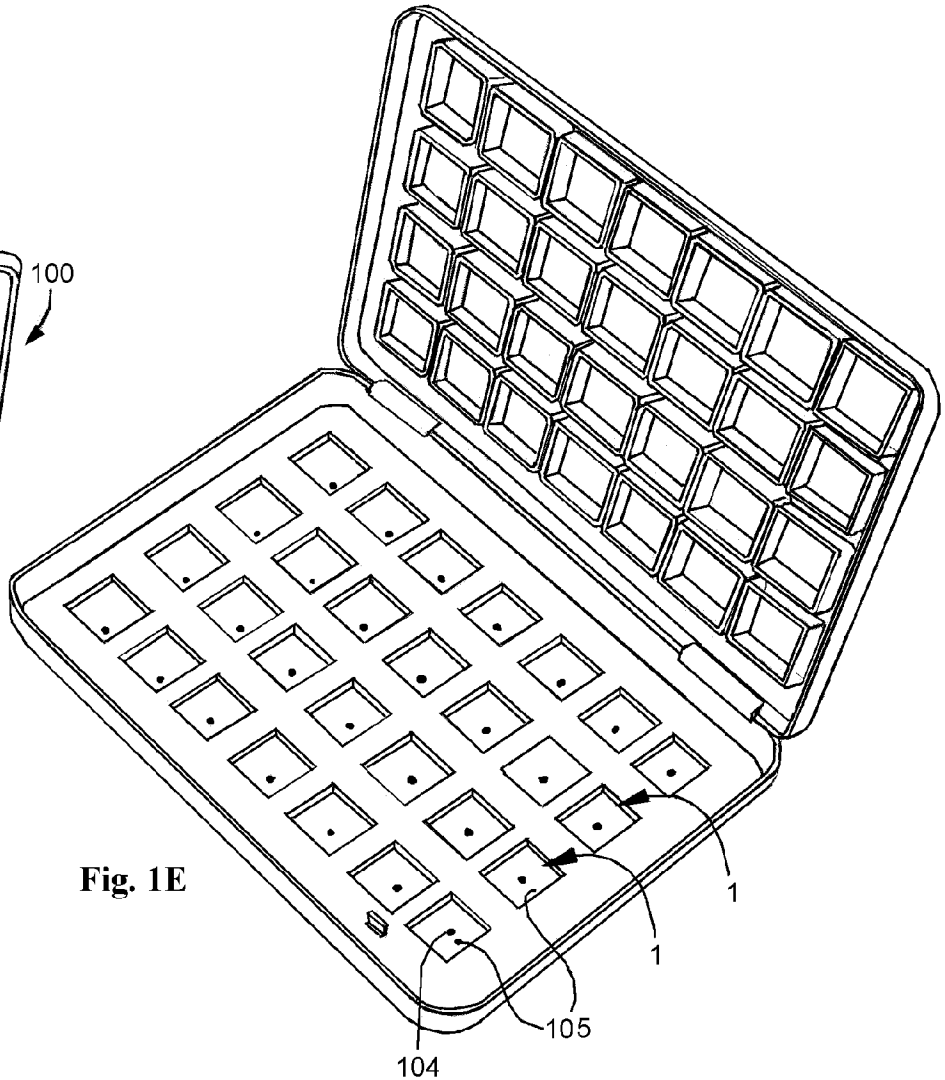
Figure 1D:
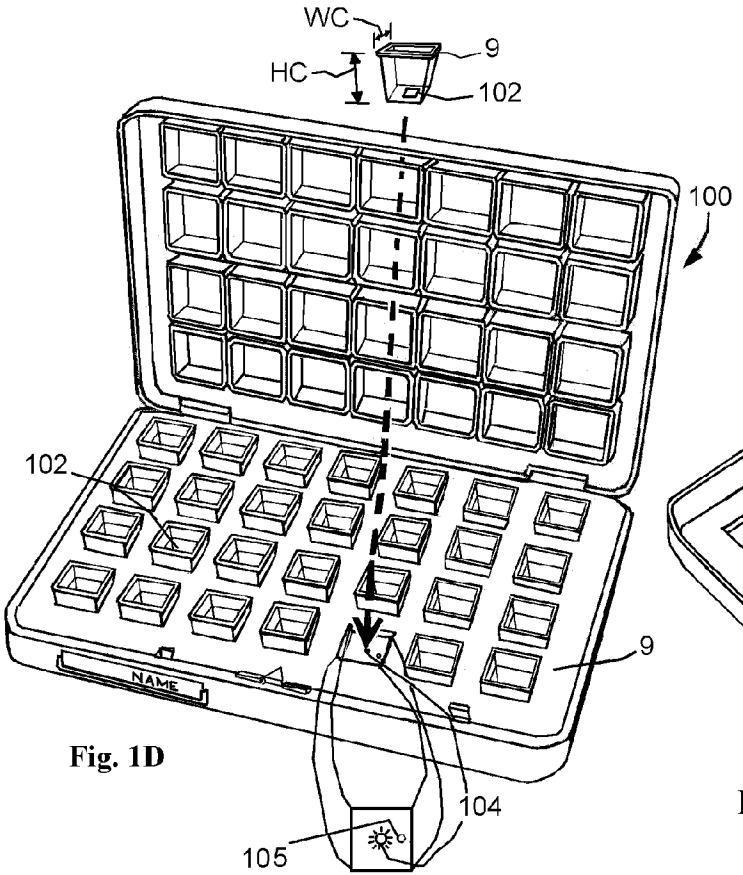

FIG. 1D shows the pillbox 100 with the bezel door 5 raised to a perpendicular position. Individual medication doses are stored in cups 9. The cups 9 are easy to handle and fabricated from a durable, lightweight material. The cup can be translucent or transparent to allow for easy medication identification and visual cue viewing and also to transmit light as described further below. The cups 9 can alternatively be provided with individual lids (not shown) to allow for transportation of an individual cup. The cups, as depicted, are cylindrical. However, in an alternate embodiment herein the cups have a square, rectangular, ovalular or other desired profile. The square profile causes it to be slightly more difficult to remove the medication dose from the squared container and encourages the user to remove the cup 9 completely from the pillbox 100, which in turn generates a report on the medication event, as described more fully below. The exemplary square profile cup 9 has a height HC of approximately one and a half inches and a width WC of approximately one inch. The dimensions can be slightly greater or less, based on a need for a larger cup or for a smaller overall profile for the pillbox 100. The individual cups 9 have a small indent 102 in the bottom of each cup that bulges slightly upwards that corresponds to the position of the exemplary LED 104 within the well of orifice of the respective compartment. The LED is an illuminated reminder indicator.

As further shown in the exploded detail view of a particular orifice, the base of which engages the associated bottom of the cup includes a LED or similar light source 104 (for example, a fiber optic tip) that transmits light in one or more appropriate colors to the body of the cup 9. The translucent material of the cup acts as a light pipe that generally illuminates the cup and provides a lighted top that is visible to the user and is a visual light cue. While the LED 104 is located within the base of the orifice, in alternate embodiments, it can be provided at any other position that provides light to the cup body.

Additionally, the base of each well or orifice includes a micro switch 106 or other appropriate presence sensor (for example, an optical, pressure or conductivity sensor). The detection switch 105 (one switch being shown by way of example) detects the presence or absence of the cup based upon its weight. This presence sensor can be located at any appropriate position with respect to the orifice. The detection switch and the LED are both operatively connected to the pillbox circuitry and are part of the feedback system for maintaining the medication schedule.

FIG. 1E is a perspective view that shows the location of the LEDs 104 and detections switches 105 in the pillbox 100. The LEDs 104 under each compartment provide visual cues to the user and a communication connector which helps the unit optionally communicate with a central server for monitoring purposes. Alternatively, the LEDs can be triggered to remind a patient to take an appropriate medication that is not in pill-form, e.g. injections, breathing treatments, or other medical treatments.

Figure 1F:
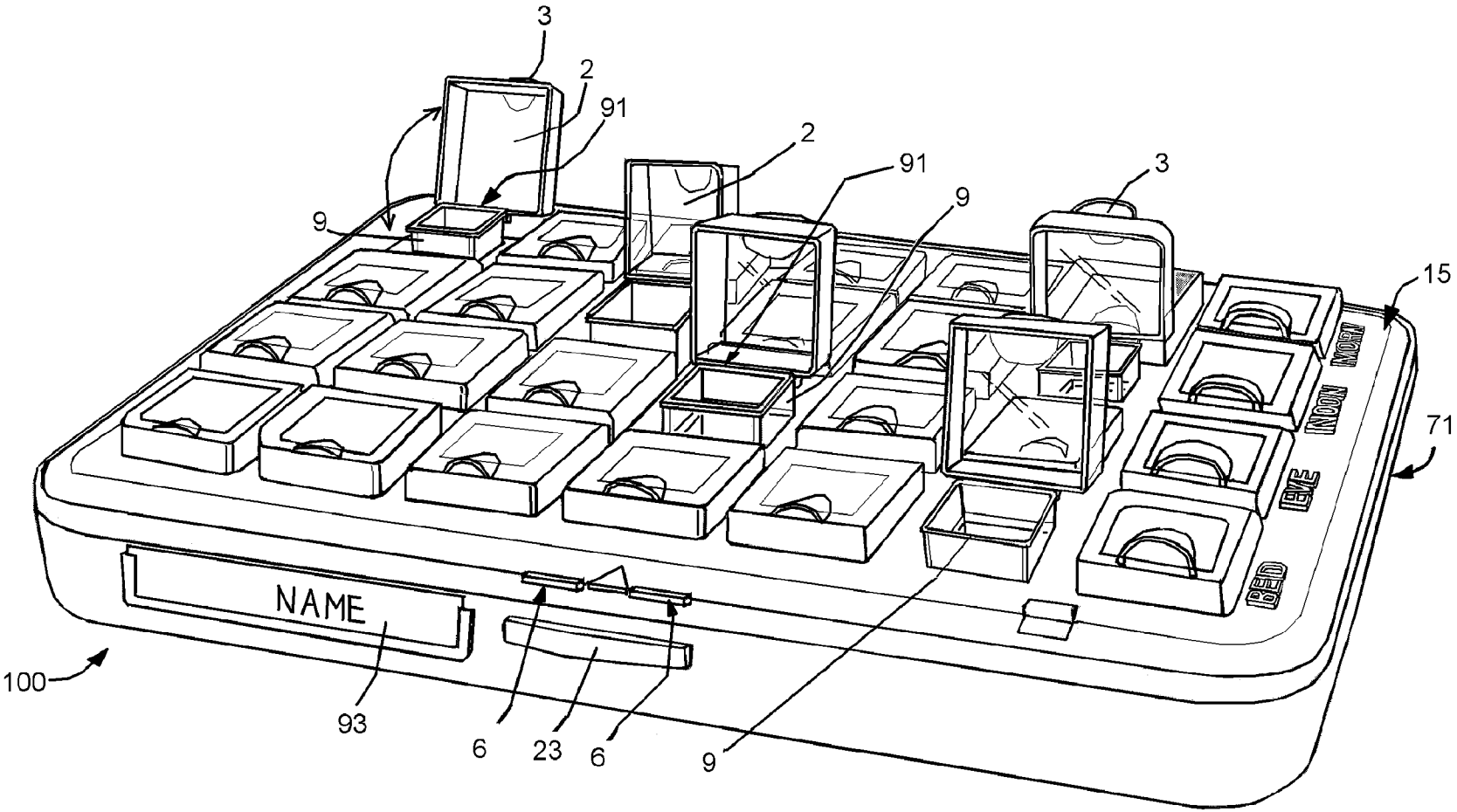

FIG. 1F is a perspective view that shows the main pillbox body 71 and the function of the compartment lids 2. The lid 2 is fabricated from a durable, lightweight material and can be transparent to allow for easy medication identification and visual cue viewing, and also to transmit light therethrough. The lid 2 is affixed to the tray 15 by operation of a hinge 91 (not shown in this figure, but more fully described below) that is pressed or clipped to the tray 71 that serves to allow opening of the lid 2 and lid and protect the medication dose within the cup 9. Each lid 2 is provided with a protruding tab handle 3 that serves to provide a catch for a fingernail, or fingernail-like object, and facilitate opening. The main pillbox body 71 is provided with a bezel button 23 that actuates the latch mechanism 6 and allows for opening when opening is needed, and secure closure when the pillbox is closed and thereby avoids accidental openings. The exemplary main pillbox body 71 is furnished with a name tag 93 that is depicted as a slotted card holder. Alternatively, the name card can be printed on a sticker or an attached LED strip or another device that establishes the identity and ownership of and by the user.

Figure 2A:
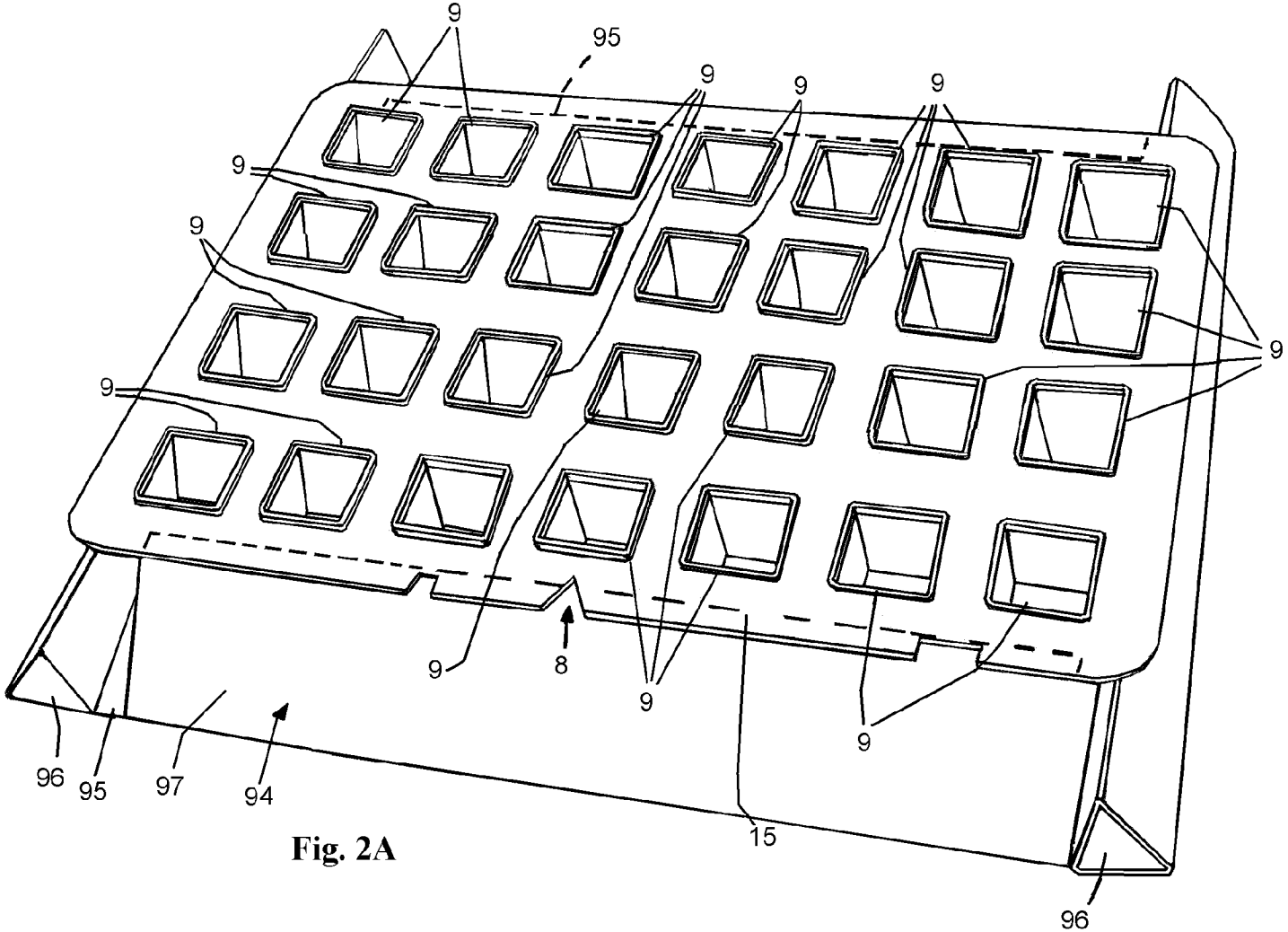
FIGS. 2A-2C depicts a medication replacement option available for the present inventions. The medication replacement option can be referred to herein as the "refill" options, where.

FIG. 2A is a perspective view of an illustrative tray 15 that is empty and ready to be refilled with medications. The tray 15 as shown has 28 compartments 1 arranged in four rows 8 and seven columns 7. The number of compartments will vary with larger and smaller pillboxes and the size requirements for doses. The tray 15 is arranged on a disposable tray holder 94. The disposable tray holder 94 is composed of cardboard or a similar disposable material that is sturdy. The disposable tray 15 can be stored on the disposable tray holder 94 with a covering (not shown) that protects the contents of the cups 9 from contamination or spoilage, such as a metal foil, plastic wrap, vacuum seal or a similar material. The disposable tray holder 94 is comprised of a bottom 95, two end supports 96 and two side supports 97. The end supports 96 and side supports 97 are fashioned in this illustrative embodiment from folding the bottom 95 so as to create a well between the ends and sides and not affect the alignment of the cups 95. Alternatively, the disposable tray holder 94 can be molded from an extruded product, or similar material, so that it has a central well that will not affect the alignment of the cups 9. The tray 15 is provided with an indicator notch 18 that serves to properly align the tray 18 when it is placed into the pillbox. The tray 15 is filled by a pharmacist or caregiver who loads the proper medication doses into the appropriate cups 9. The tray 15 is then sealed with a covering, as described above, and provides the tray 15 to the user.

Figure 2B:
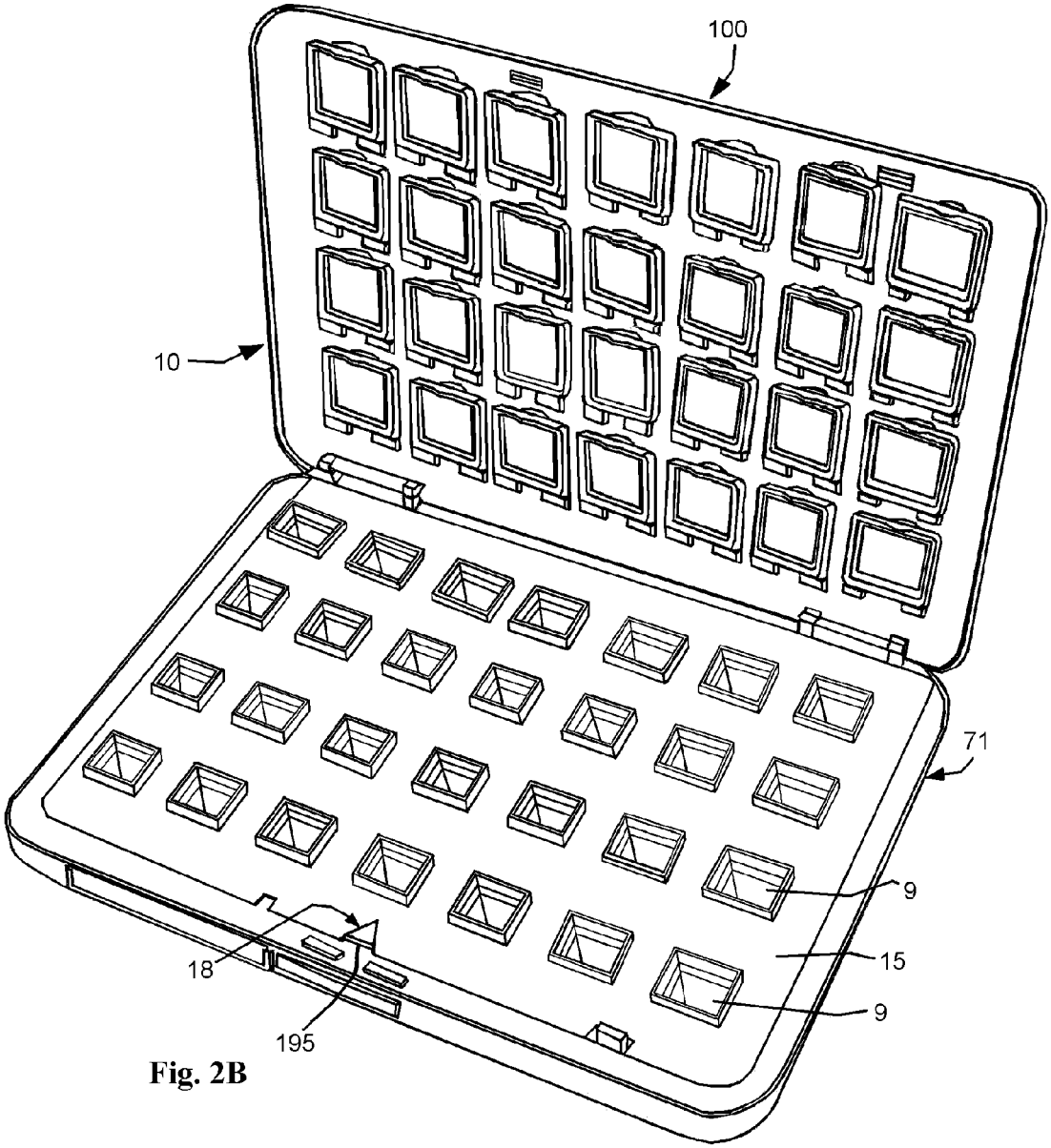

FIG. 2B is a perspective view of an illustrative pillbox 100 that has been refilled with a refillable tray 15. The bezel door assembly 10 is open. With the bezel door assembly 10 open, the tray enables easy refilling of the medication. The tray 15 is placed into the main pillbox body 71, using as an alignment reference the alignment notch 18. The notch 18 provides proper positioning of the refill tray during loading by aligning with alignment indicator 195 located on top housing 327. The tray will remain there until the next refill.

Figure 2C:
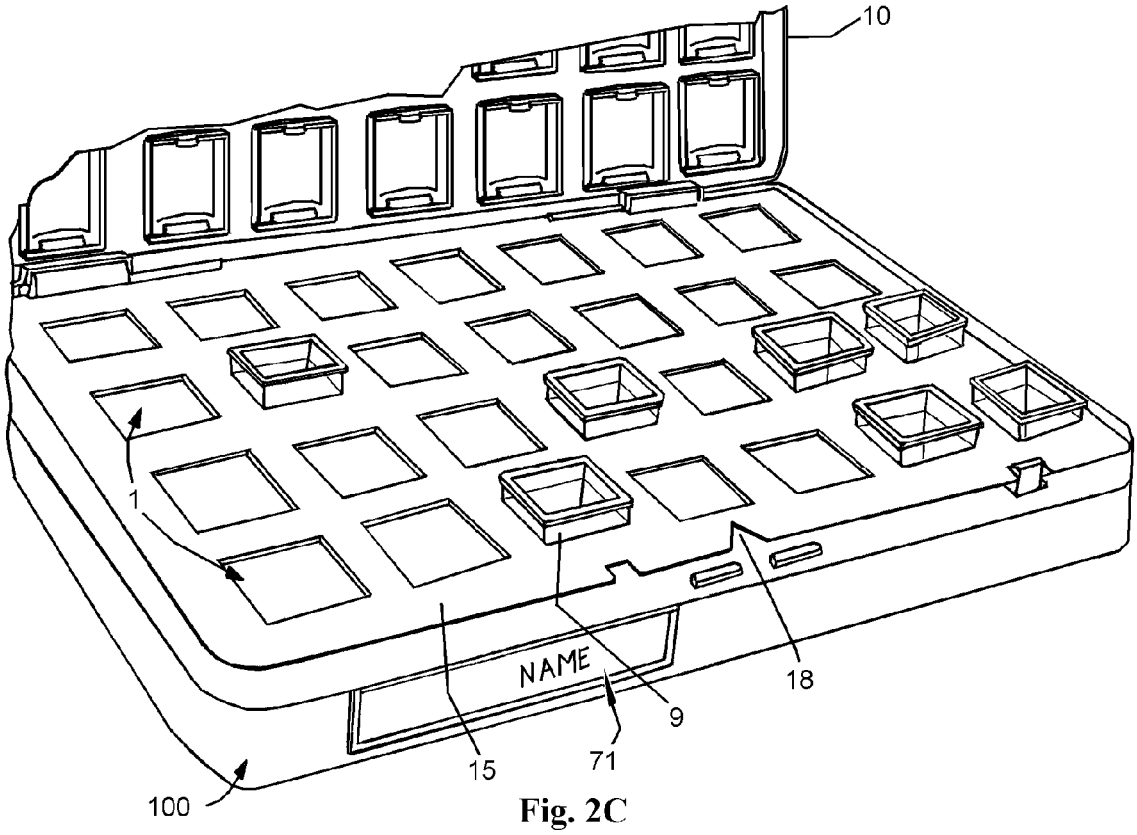

FIG. 2C is a perspective view of an illustrative pillbox 100 that contains a partially filled tray 15. The bezel door assembly 10 is open and the main pillbox body 71 is exposed. In this exemplary embodiment, the refillable tray 15 is being serviced and one particular medication is being placed into the compartments 1, according to a medication therapy regime. Most of the compartments 1 are empty and only seven compartments 1 contain cups 9. This provides for a group treatment of the medication doses by the person refilling the tray in this incremental manner.

Figure 3A:
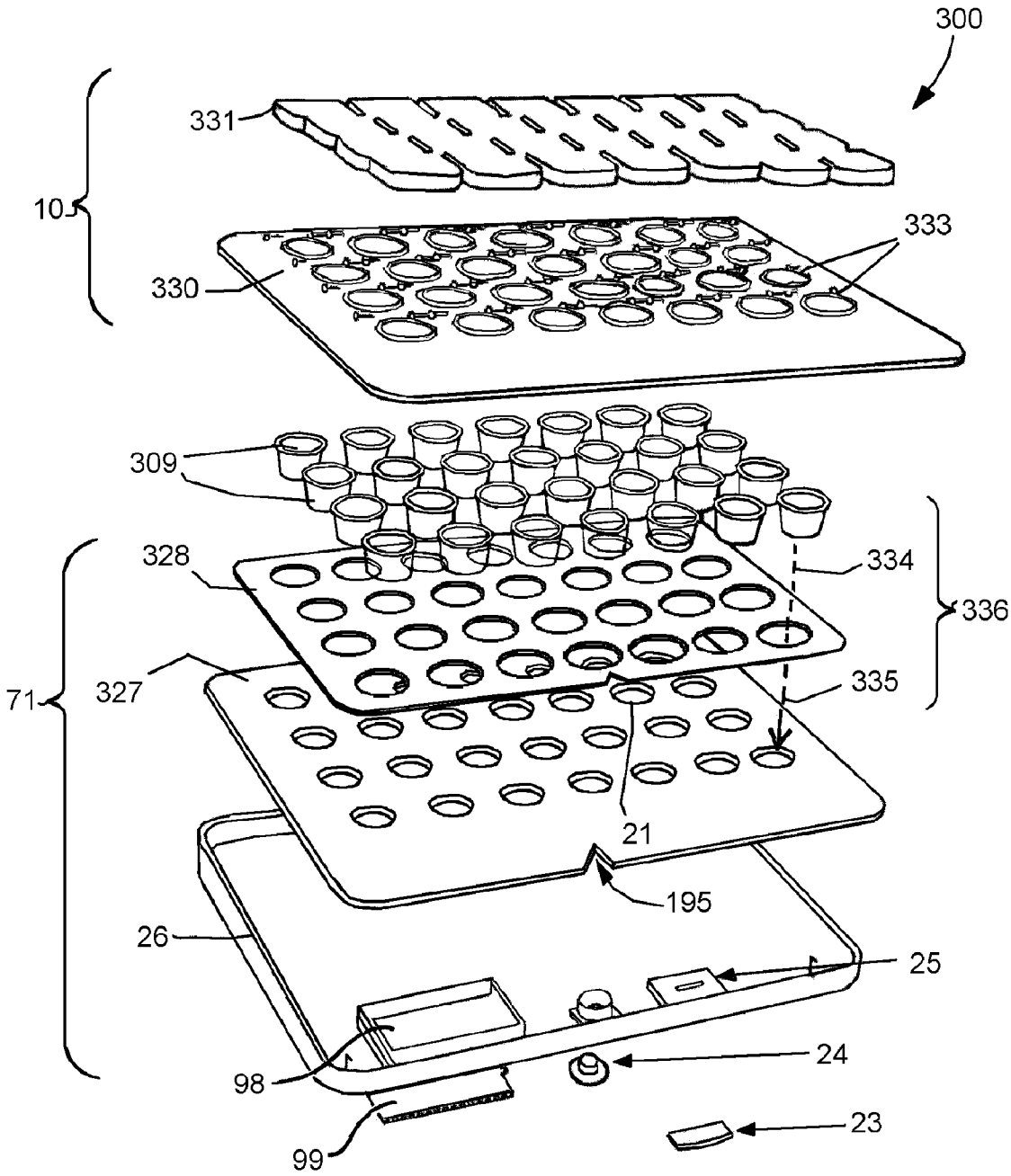
FIGS. 3A-3C depict a perspective view of each component of another illustrative embodiment of an invention hereof, where

FIG. 3A is an exploded perspective view of another illustrative pillbox 300, in which the components are separated for explanation and like parts are given like numbers. The exemplary pillbox in this embodiment utilizes cups 329. The bezel door assembly 10 consists of the bezel door 330 and clear lids 331 with latches to keep them shut. The clear lids 331 allow for easy inspection of the medication doses. The main pillbox body 71 is comprised of a bezel button 23, bezel lock 24, bottom housing 26, with integral on/off switch 25, a top housing 327, a refillable loading tray 328 with cups 333 and an orientation reference notch 21, and cups 329 that are corresponding in shape to the cups 333. Each compartment corresponds to a day/time scheduled medication dose and has medication dispensing units, cups 329 in this embodiment. The cups 329 fit neatly into orifices 336, the orifices including holes 334 and slots 335. Holes 334 provided in a loading tray 328, which sits on top of the top housing unit 327 which has corresponding slots 335 that align with the holes 334 and receive the cups 329 via orifices 336. The loading tray 18 is analogous to the refillable pharmacy tray 15, as shown in FIG. 2A above. The top housing unit 327 fits over a bottom housing unit 26. The bottom housing unit 26 includes the integral on/off switch 25, the bezel lock 24 and the bezel button 23. The exemplary bottom housing unit 26 is equipped with a battery compartment 98 and battery compartment lid 99 for secure housing of power batteries.

Figure 3B:
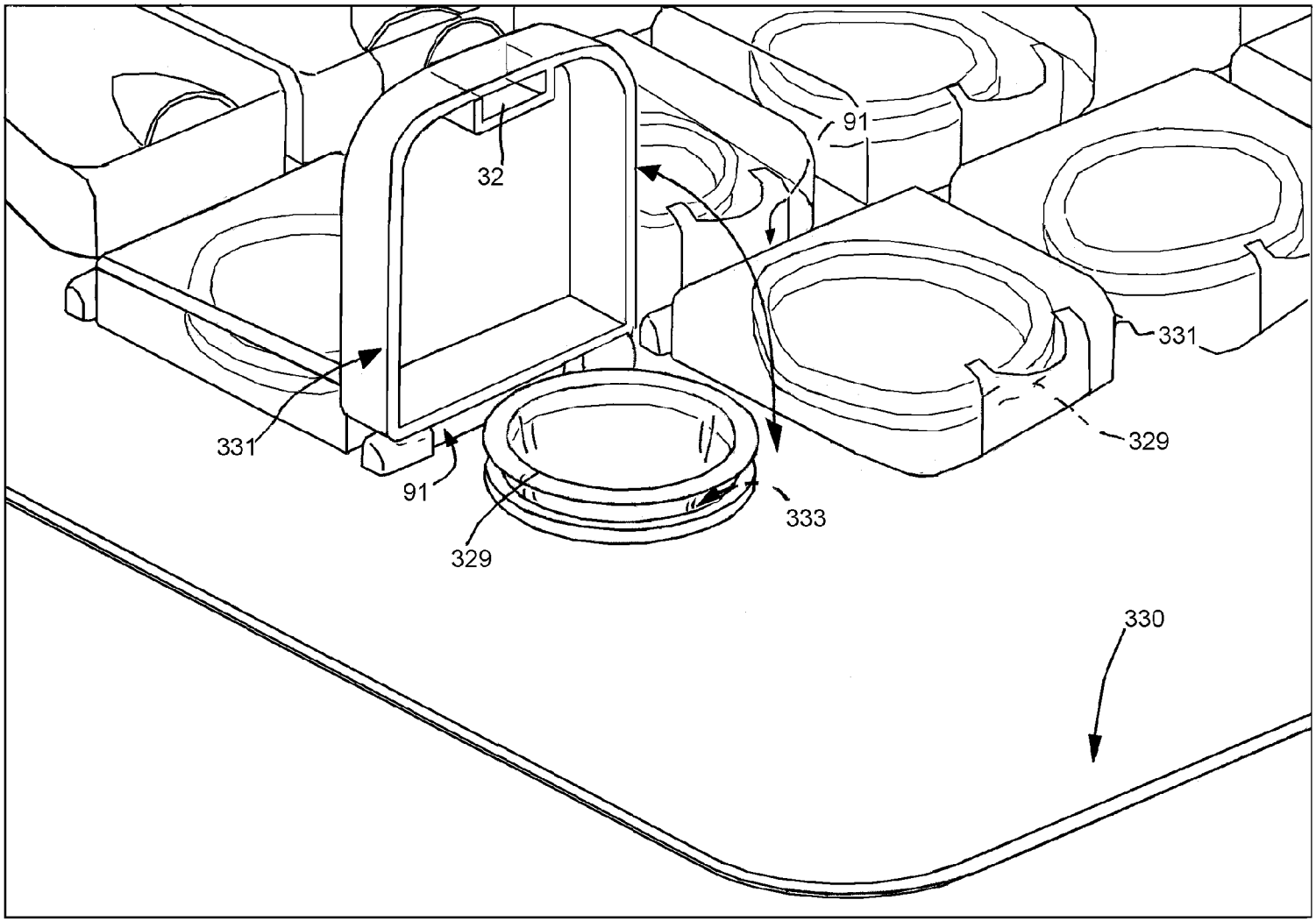

FIG. 3B is a partial perspective close-up view that illustrates the detail of a lid 131. The lid is mounted to the bezel door 330 by operation of a hinge 91. The lid 131 includes a latch mechanism 32. The latch mechanism can be a shoulder detent snap-fit type mechanism or any other such mechanism that removably secures the lids in place, e.g. a magnet. The lid 131 swings shut to cover the individual cup, in this example, a cup 329, which is set into the compartment 333. The cup 329 is raised above the top of the compartment 333 for easy removal.

Figure 3C:
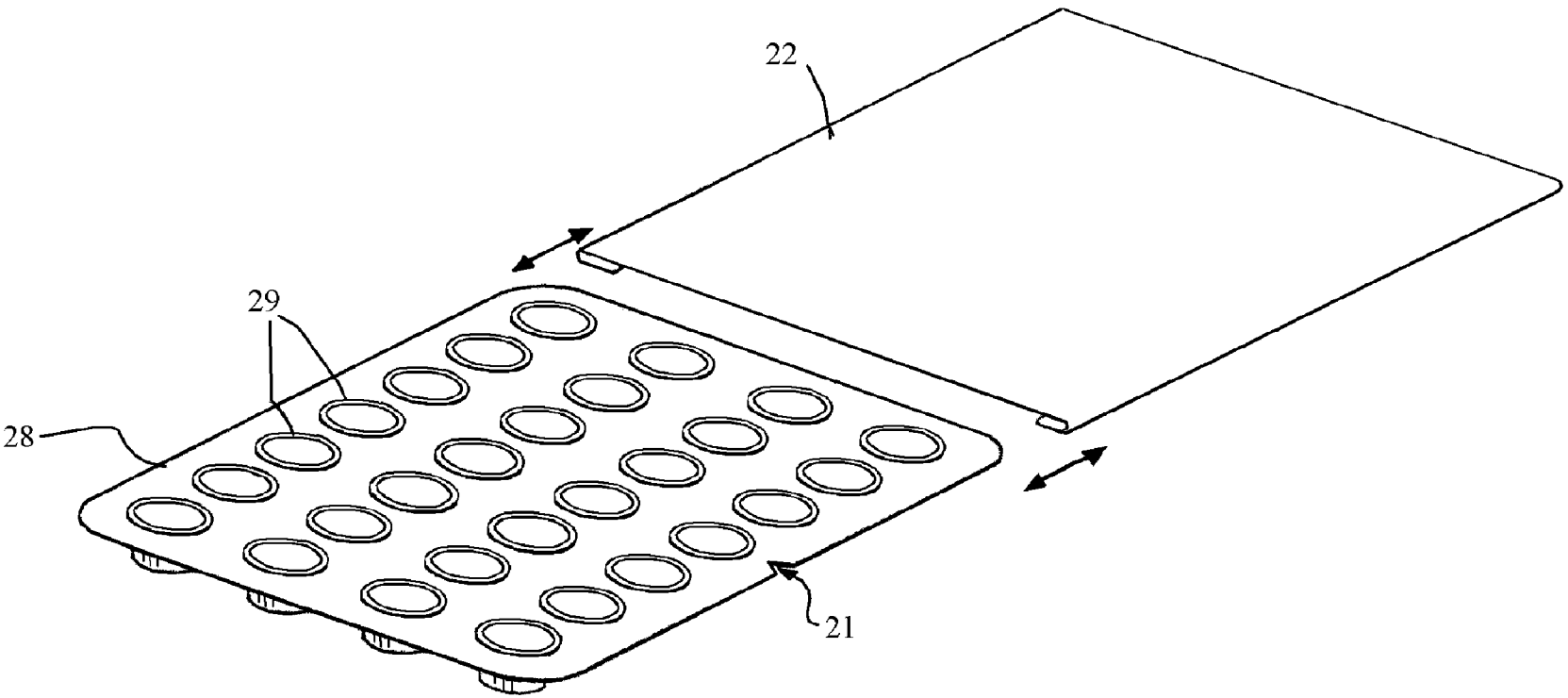

FIG. 3C is a perspective view of an exemplary refillable tray 328 having compartments, in this case, that have been filled with cups 329. A removable cover 22 is provided to ensure integrity and security for the medication doses. The exemplary removable cover slides laterally onto the tray 328. In an alternate embodiment, the cover is fashioned from a metal foil or shrink wrap that is torn off prior to use, attaches with Velcro™ or an adhesive, secures with snap clips or tabs, or some other secure mechanism that provides an impermeable protective cover over the tray 328 and its contents and prevents loss, tampering, pollution or spoilage. The locator notch 21 helps with ease of use and provides the ability to place the tray in its correct location as discussed above.

Figure 4:
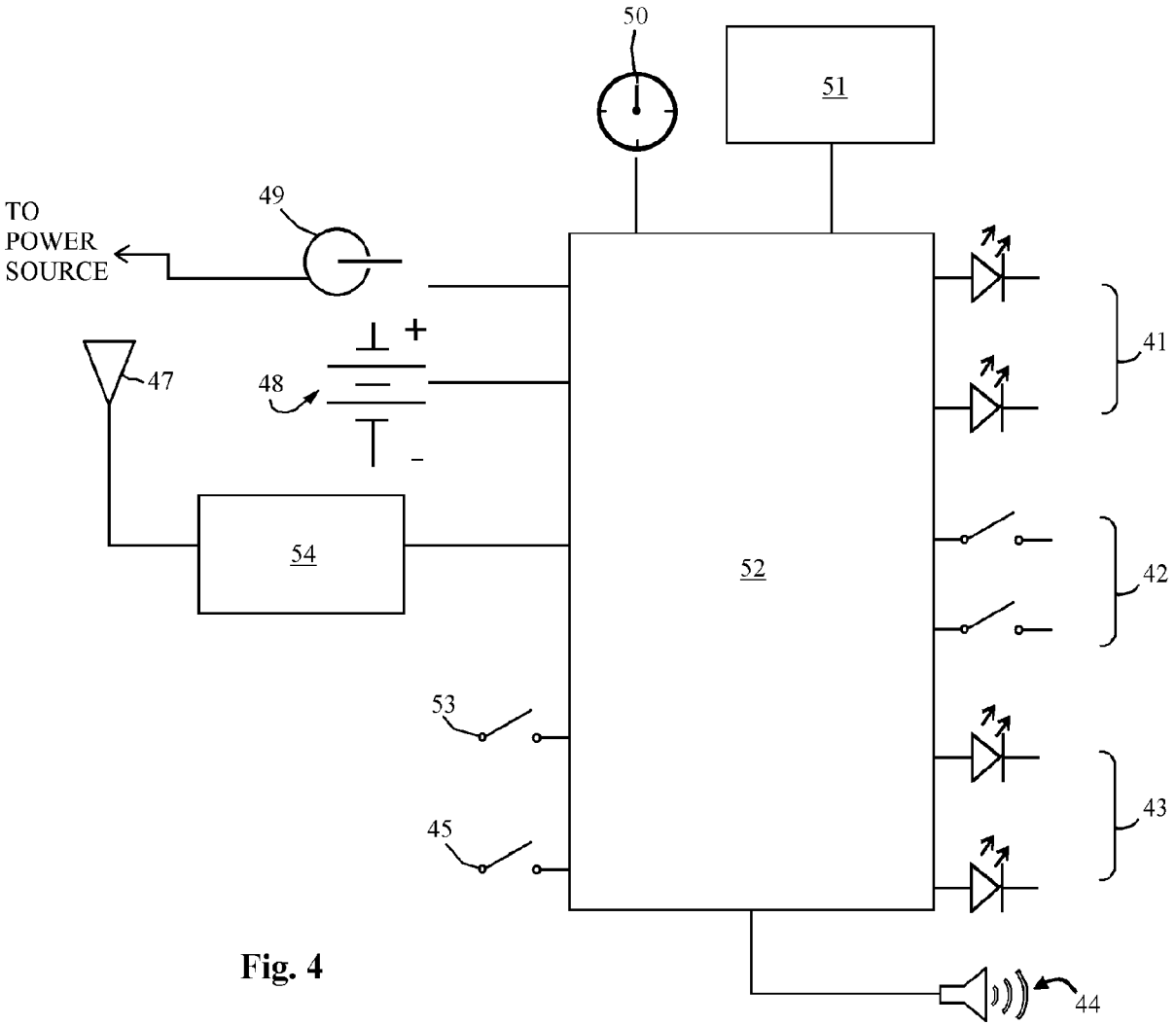
FIG. 4 is a schematic view of a block diagram of the components of an apparatus of an invention hereof, that includes a set of medication compartments, microprocessor, communications link and user interface elements such as light and sound producing components.

FIG. 4 is a schematic block diagram 400 of the interrelation of the electrical components of an exemplary pillbox. The unit functions with a microprocessor 52. Compartment LEDs 41 is integrated with the microprocessor 52 to provide visual cues. Detection switches 42 detect at least one of the placement, removal and replacement of the individual cups by operation of a micro switch, or any other appropriate device for sensing presence or weight thereupon. Removal or replacement of an individual cup triggers the compartment switch and changes the overall configuration of the system, which can be logged and recorded for data collection purposes. The tray open switch 53 detects the placement of a refillable tray. The Bezel open switch 45 detects the placement of the bezel door. There are two LEDs 43 that indicate the configuration of the unit to the end user. The speaker/buzzer 44 provides auditory alerts and cues to the user. Power to the pillbox is provided by either a battery 48 or a power supply 49, which connects to an outside power source. A real-time clock 50 enables the unit to provide timely reminders and communicate with the external central computing device. The non-volatile memory 51 stores the medication and refill schedule data as potentially provided to the pillbox when it is connected to the external computing device. Lastly, the exemplary pillbox has a communication connector 47 which aids its communication with the external central computing device through the communication link 54.

There need be no switches or buttons or other input devices that the user must operate to communicate that the medication has been taken. The lids of the individual compartments and/or the cups themselves serve the function of what might be served by user input buttons or switches, namely, of indicating that the compartment has been opened, from which it can be inferred that the patient has taken the medication. Thus, the device elegantly solves the problem of how the user can communicate the fact that the medication has been taken, by using elements of the structure of the pillbox itself to stand in for explicit user input devices, such as switches and buttons. This significantly simplifies actual use, and essentially allows the user to simply use the box as a storage receptacle, without even thinking about its reminder, data gathering and other functions. Thus, it is an important aspect of some inventions disclosed herein, that there need be no user input devices associated with the pill dispensing function, such as switches or buttons, and that the cups (with associated sensors), and/or compartment lids (with associated sensors), serve related user input functions.

Figure 5A:
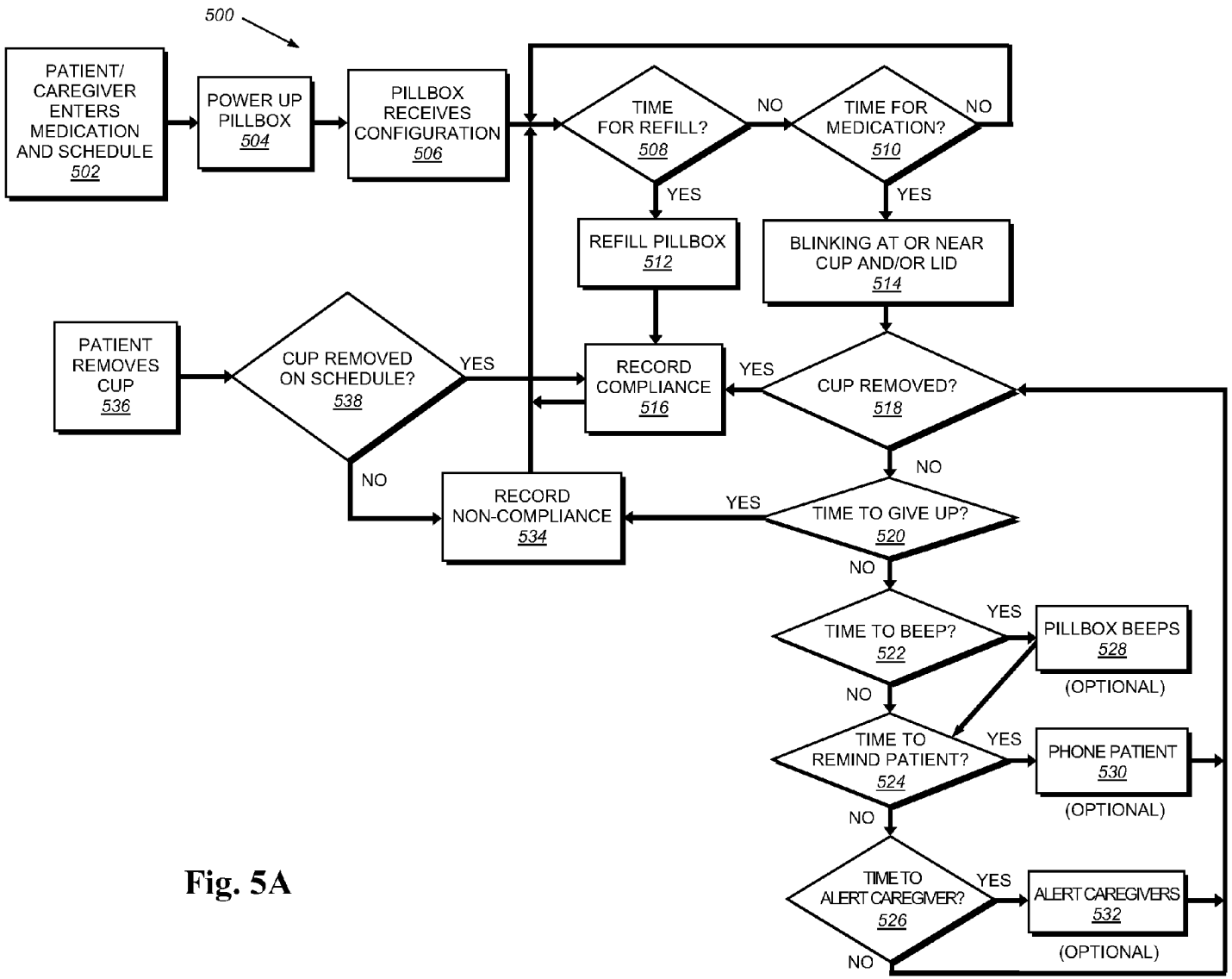
FIGS. 5A-5D depicts, schematically, in flow chart form, a series of process steps that involve an embodiment of an apparatus of an invention hereof, including steps for setting up the medication schedule that can reside on a remote computing device; actions and queries conducted by the pillbox and interactions the pillbox has with a remote computing device, where

FIG. 5A is a flow chart diagram 500 that teaches a system consisting of a number of work flows that displays the overall processes and functions of the pillbox. The process commences when the patient or caregiver enters information, or updates to information, about each medication the patient needs to take at a manager application at the central computing device 502. Updates to the information, including changes to schedules, alerts, and alert recipients can be made at the manager application and sent from the central server and communicated to the pillbox via network 606, as set forth more fully below. The manager application can take the form of a web site, software application or any other database interface and can be utilized at any time to change a patient's medication profile. The data entered by the user will then be stored in a data store such as a database. For each medication, the user will need to specify the quantity and day of week and time of day that the medication needs to be taken. Further, for each medication they will have a choice of receiving auditory and/or visual cues from the unit, as well as optionally a wrong lid tone and different levels of auditory cues. The user will also need to configure valid time windows corresponding to each day set compartment for medication consumption during the day. For example they can set up a morning window from 7AM-9AM, a noon window from 12AM-2PM, and evening window from 6PM-8PM and a nightly window from 10PM-12PM. They can also set up a refill window, potentially specifying the day of week and time of day that the refill is expected to be executed. Lastly, the user is able to schedule the time at which they expect the auditory cues to begin relative to the end of the medication window or refill window, as well as the time they expect themselves or their caregivers to be alerted for non-compliance.

The pillbox is then powered up 504, initiating a configuration subroutine that will be more fully described in FIG. 5B below. The configuration information is then received by the pillbox 506. The system then queries as to need for a refill 508 and generates a reminder via the status indicator and/or via the server in the form of a prompting signal (for example, a phone call, text message, sound cue, light effect, or the like) to the user and/or caregiver, or, if selected, to the designated pharmacist. If it is, then the system will initiate a refill routine 512 and make sure that the records are compliant 516 and return to the refill query. If the refill query 508 is answered in the negative, then the system will query for medication time 510. If the answer is no, then the system will return to the question of refill timing 508. If the answer is yes, then the pillbox LED will initiate the reminder process and begin a blinking light function 514 to alert the user. The system now queries as to whether the compartment has been opened during the scheduled window 518. If the patient takes their medication during the scheduled window and the compartment has been opened, then the pillbox communicates this compliance information to the server 516. If the compartment has not been opened, then the system queries as to whether it is time to give up 520, and if yes, record the non-compliance 534 and return to the refill timeliness query. If the patient does not take their medication following the visual cues, the next set of cues is auditory—in the form of beeping, unless a different auditory cues has been selected. If it is not time to give up, then the system queries as to whether it is time to beep 522 and if yes, then beep 528, if it is set to allow audio emissions in the form of beeps. Prior to the end of the scheduled medication window, the unit communicates a message to the server to initiate a phone call to the patient to remind them to take their medication 524. If it is time to remind the patient, then the system phones the patient 530 and checks for the removal of the cup from the respective orifice 518. Lastly, at a scheduled time prior to the end of the medication window, the server will either be notified, or will itself initiate an alert to the patient's caregivers via an alerting mechanism such as email or Short Message Service Method (SMS) 526. If it is time to alert the caregivers, then the alert is given 532 and the system checks for the cup removal 518. If it is not time to alert the caregivers, then the system queries the cup removal 518. When the patient removes the cup 536, the system queries whether the cup removal is on schedule 538. Finally, if the patient does not take the medication at a predetermined period after the medication window, the unit will alert the server and record the non-compliance event 534. If the compartment opening is on schedule, then the system records the compliance with the server 516.

Figure 5B:
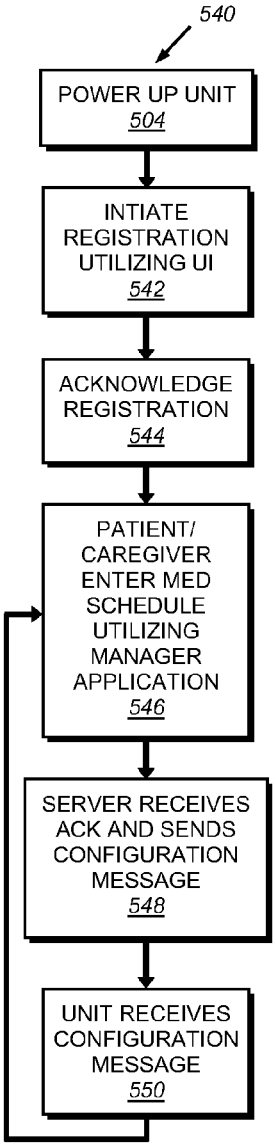

FIG. 5B illustrates the power up and configuration subroutine 540. When the pillbox unit is powered up 504, the registration process initiates at the central server 542. Once this process is initiated, the registration receipt is acknowledged by the user at the pillbox 544, verifying that the communication circuit between the account at the server and the physical box has been established. The patient or caregiver then enters the medication schedule, utilizing the manager application 546. The central server on receipt of the registration acknowledgment now sends the patient specific scheduling and medication data to the pillbox for use 548. As the unit receives this configuration information 550 is stores it in non-volatile memory, and is then ready to function.

Figure 5C:
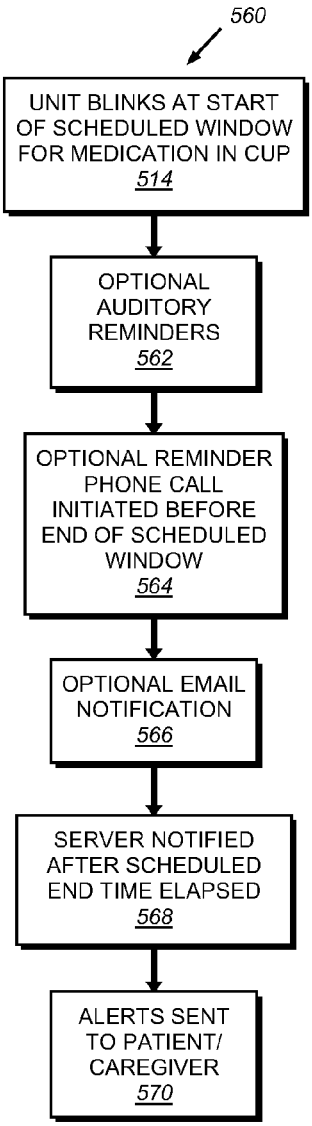

FIG. 5C is a flowchart that illustrates the reminder process 560 explained above. The pillbox unit blinks 514 at the start of the scheduled window for taking the medication dose in a particular compartment. The alert can include optional auditory reminders 562 in the form of beeps. In an alternative embodiment, sound, musical or recorded voice cues can be utilized as auditory reminders. After this, a reminder phone call can be initiated prior to the end of the scheduled medication window 564, if this option has been selected. The next reminder cue is an email notification 566 or text message. After the scheduled medication end time has passed and if the medication has not been taken, then the server is notified 568 and alerts are sent to the patient and/or patient caregivers 570.

Figure 5D:
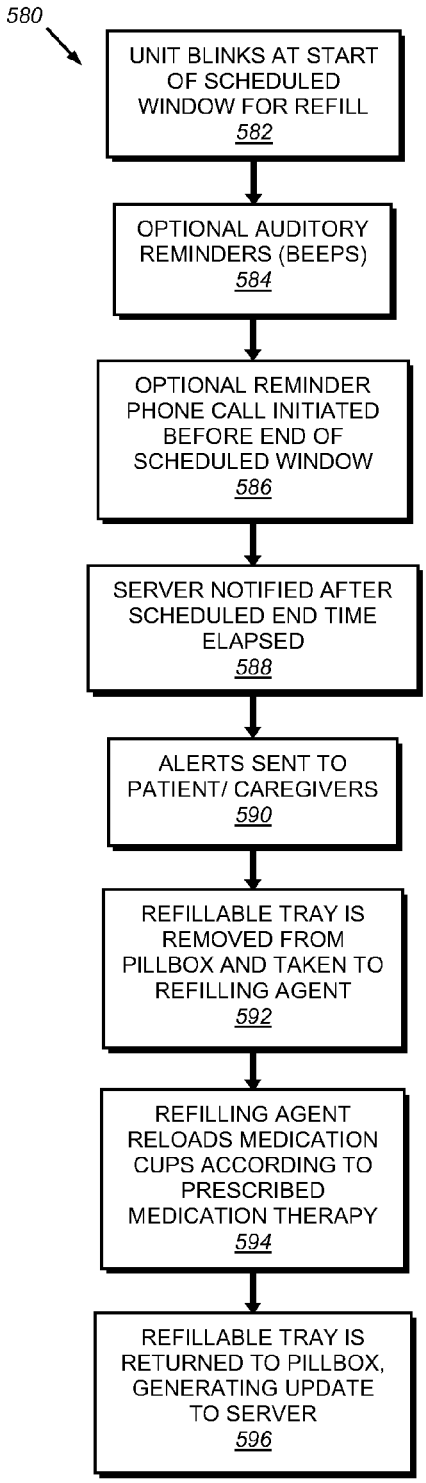

FIG. 5D is a flowchart that illustrates the refill process 580. The pillbox initiates the refill process 580 by recognizing that it is time for the refill 512. If the refill process does not start at the scheduled time, this is indicated by visual 110 and/or auditory cues 584. Following this, if the refill process has not commenced, the unit will potentially initiate a phone reminder 586 to the patient and/or caregiver. If the end time of the refill window is reached before the refill is either initiated or completed, the unit will notify the central server 588, which will alert the appropriate persons via previously specified methods such an email or Short Message Service (SMS) Methods 590. The user can remove the refillable tray 15 from the pillbox 100 and can take it to a refilling agent 592, e.g. a caregiver, pharmacist, or the patient him/herself. Upon receipt of the tray, the refilling agent reloads the cups 9 in accordance with the prescribed medication therapy 594. The refillable tray 15 is returned to the pillbox 100, ensuring proper alignment by aligning notch 18 with an alignment indicator 195. At this point, the pillbox 100 generates an event report that is sent to the central server or stored in the non-volatile memory for upload to the central server at a later time.

Figure 6:
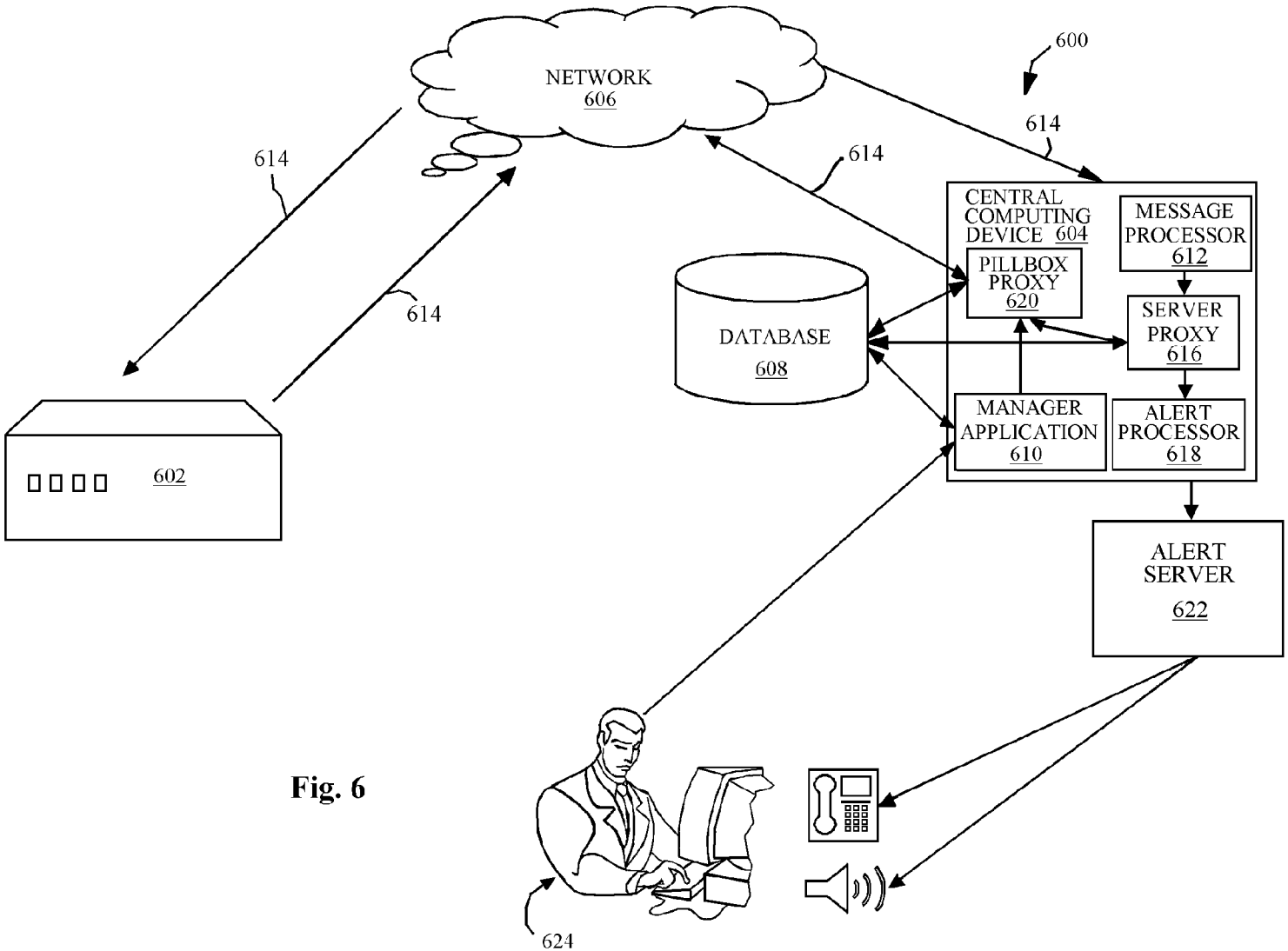
FIG. 6 depicts schematically a block diagram of the various components of an exemplary embodiment of the system described herein. This diagram illustrates the overall system architecture and interactive nature.

FIG. 6 is a block diagram that illustrates the system architecture of the entire system 600. An exemplary pillbox 602 and an illustrative central computing device 604 are linked together via a network 606. Pillbox 602 automatically links to network 606, without the need for user interaction. However, in the event of a connection interruption between the pillbox 602 and the network 606, the pillbox can operate autonomously according to the patient specific scheduling and medication data that is stored in the pillbox's non-volatile memory. Upon reconnection, the compliance data gathered during the downtime is automatically uploaded to the central computing device 604. The central computing device 604 can be a single server or a farm of computer servers. The central computing device 604 stores user, medication, schedule, pillbox data, as well as all event and compliance data, in a database 608. The data in the data store can be manipulated by a manager application 610. The software on the central computing device 604 comprises a message processor 612 which receives messages from the pillbox through a communication link 614. These messages are then passed onto software that functions as a server proxy 616 and appropriately communicates with the alert processor 618, the database 608 and the pillbox proxy 620, whose function it is to communicate with the pillbox 602 via the communication network. The alert processor 618 communicates with an alert server 622 that appropriately initiates an alert to the caregiver 624 via email, Short Message Service (SMS) Methods, phone or any other alerting mechanism.

The compliance and non-compliance data that is collected by the central database 608) is beneficial to this device. This data can then be distributed in various forms such as reports, and in varying frequency—such as real-time, daily, weekly or monthly reports in either single patient or multiple aggregated patient forms.

Figure 7A:
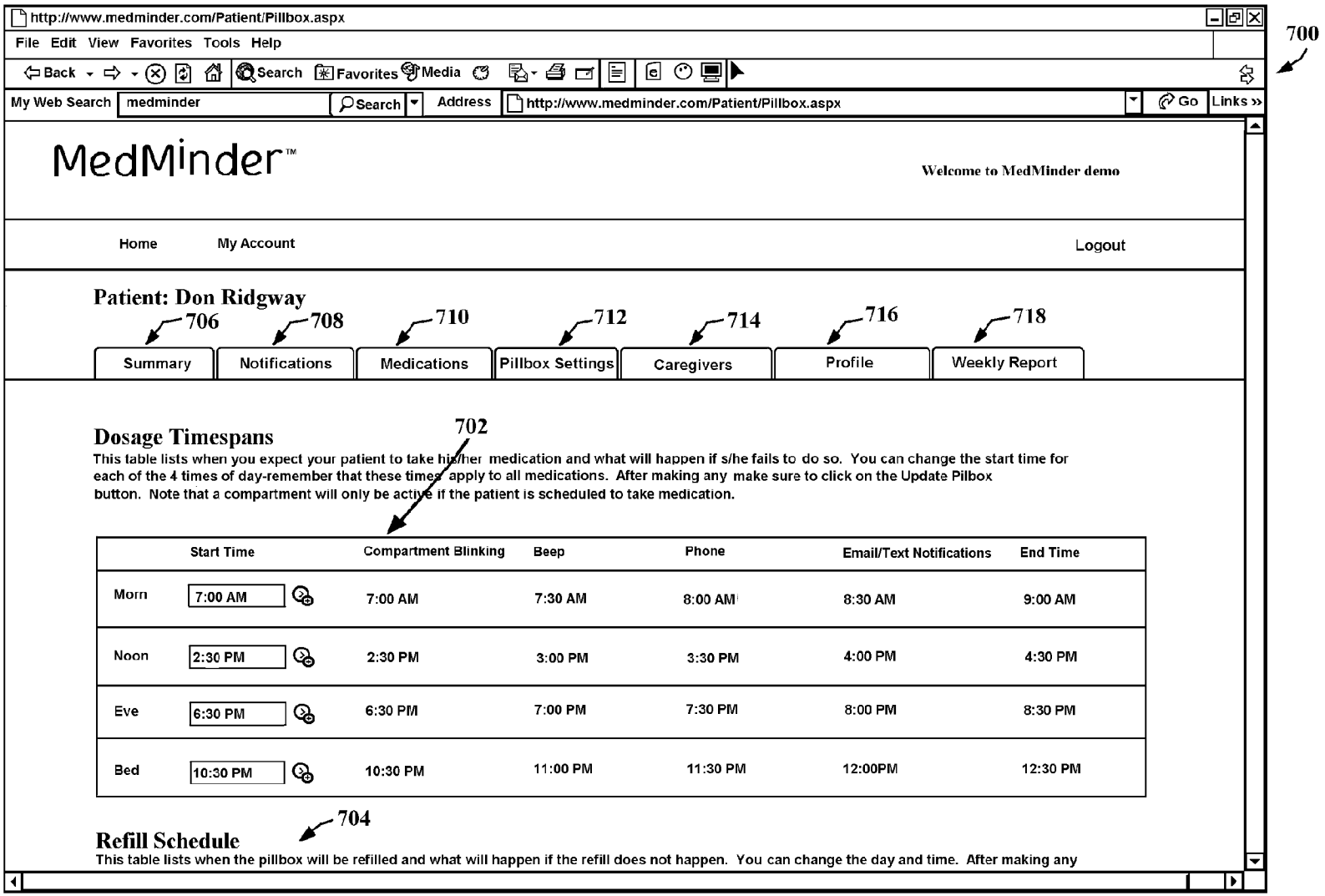

FIG. 7A shows a screenshot of a pillbox configuration interface 700 found in an illustrative embodiment of a manager application residing at the computing device. The manager application is either a desktop application or a web interface which communicates with a server at the back-end. This screen enables the user or an interested party (for example, a physician, caregiver, pharmacist, family member or other privileged party) to establish medication dosage schedules 702 which correspond to the row indicia on the pillbox unit, configure the refill schedule 704, and allows the user to customize the alerts.

The screenshot in FIG. 7A presents a variety of tabs. In this illustrative embodiment, the text presents seven functional screen tabs. The screen is currently set for the "Pillbox Settings" tab 712, and presents the dosage time span, including the medication dosage schedules 702 and refill schedule 704. The user can select to shift to one of the other tabs. These tabs remain usable on each screen. The other screen tabs include "Summary" tab 706, "Notifications" tab 708, "Medications" tab 710, "Caregivers" tab 714, "Profile" tab 716, and "Weekly Report" tab 718.

Figure 7B:
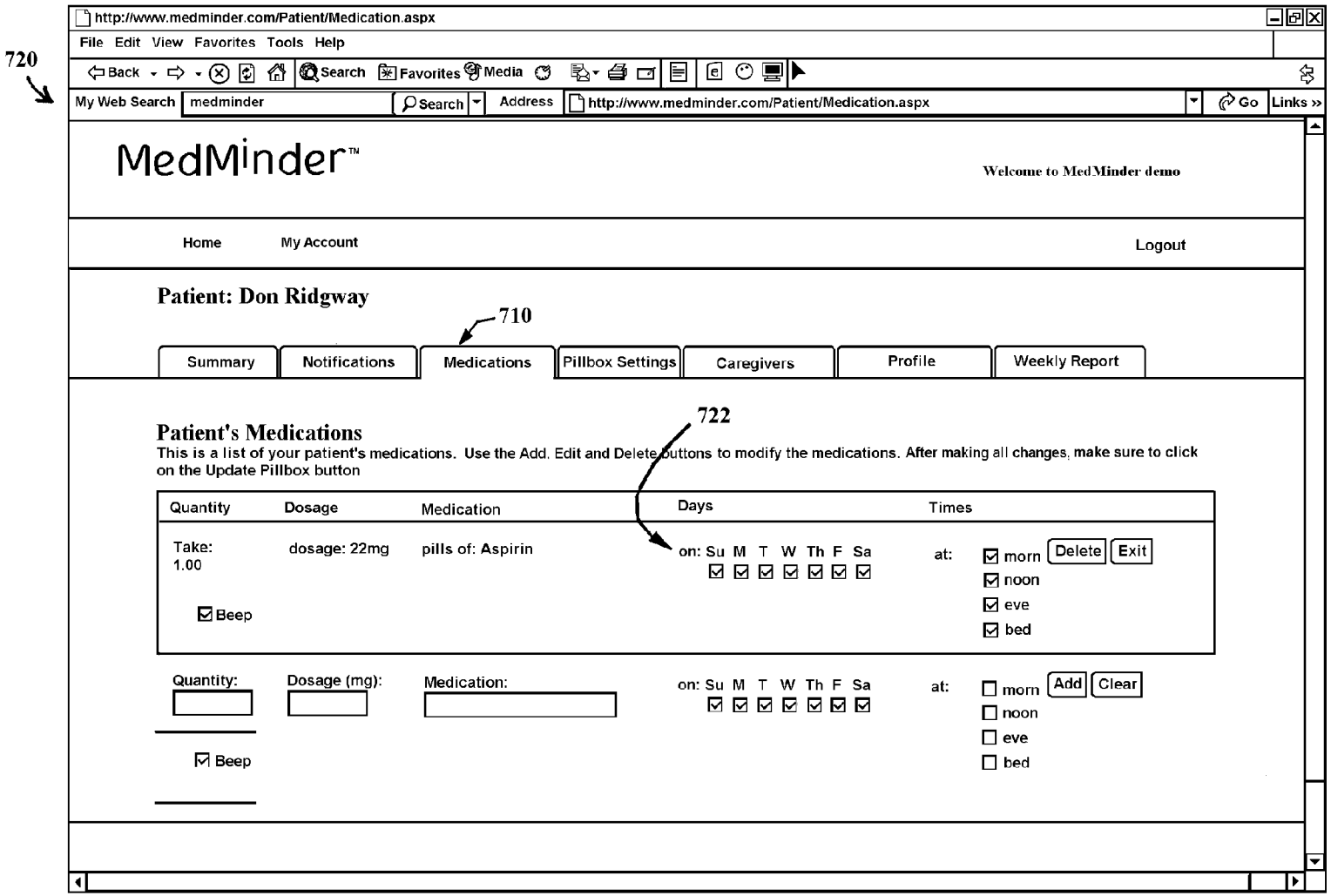

FIG. 7B shows a screenshot of a medication scheduling interface 720 found in the above embodiment. The "Medications" screen tab 710 has been selected. This screen enables the user to set up the schedule for medication 722 by date and times.

Figure 7C:
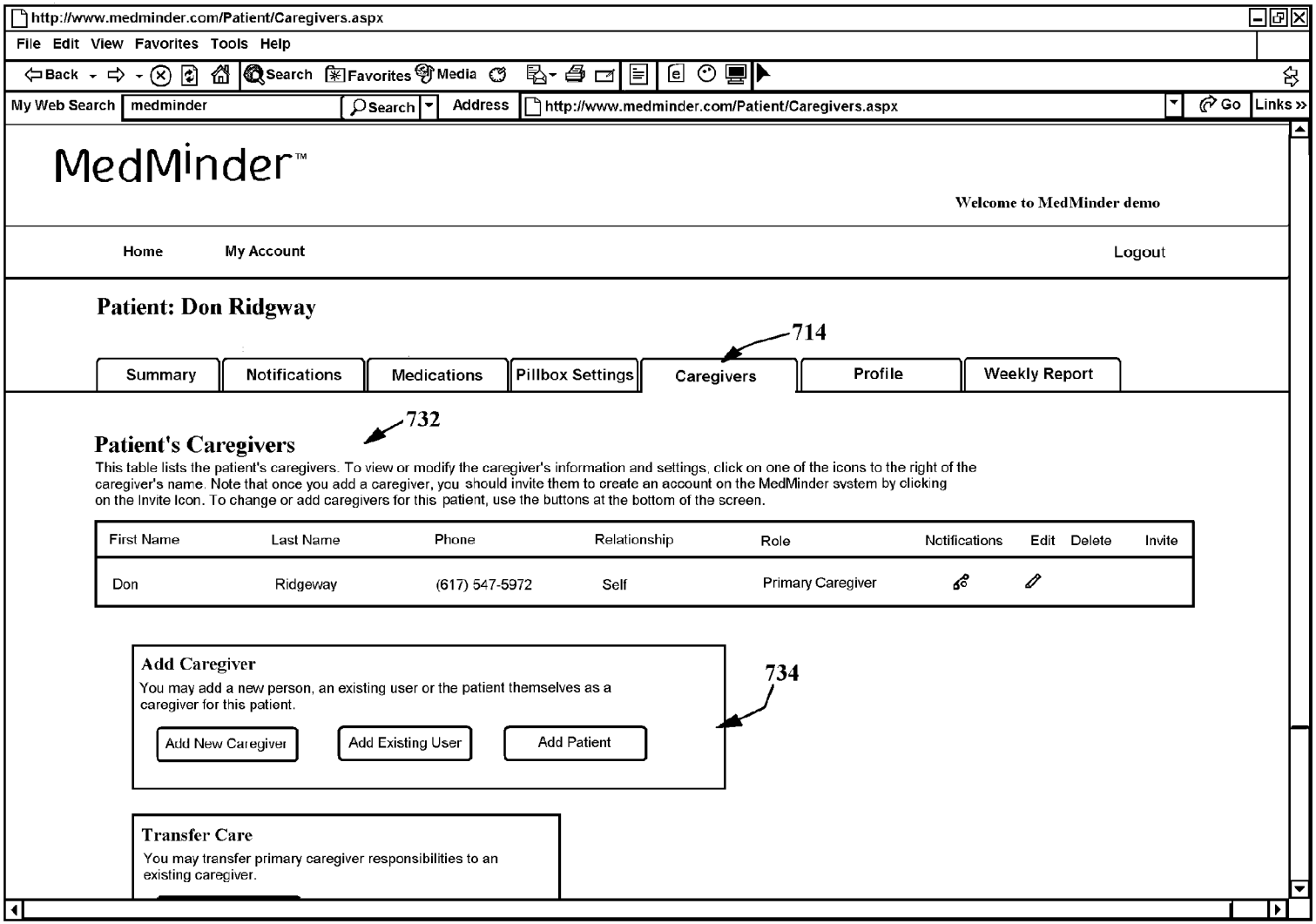

FIG. 7C shows a screenshot of a caregiver listing interface 730 found in the above embodiment. The "Caregivers" screen tab 714 has been selected. This screen enables the user to list all caregivers 732 and important contact information. This interface also permits addition of new caregivers 734.

Figure 7D:
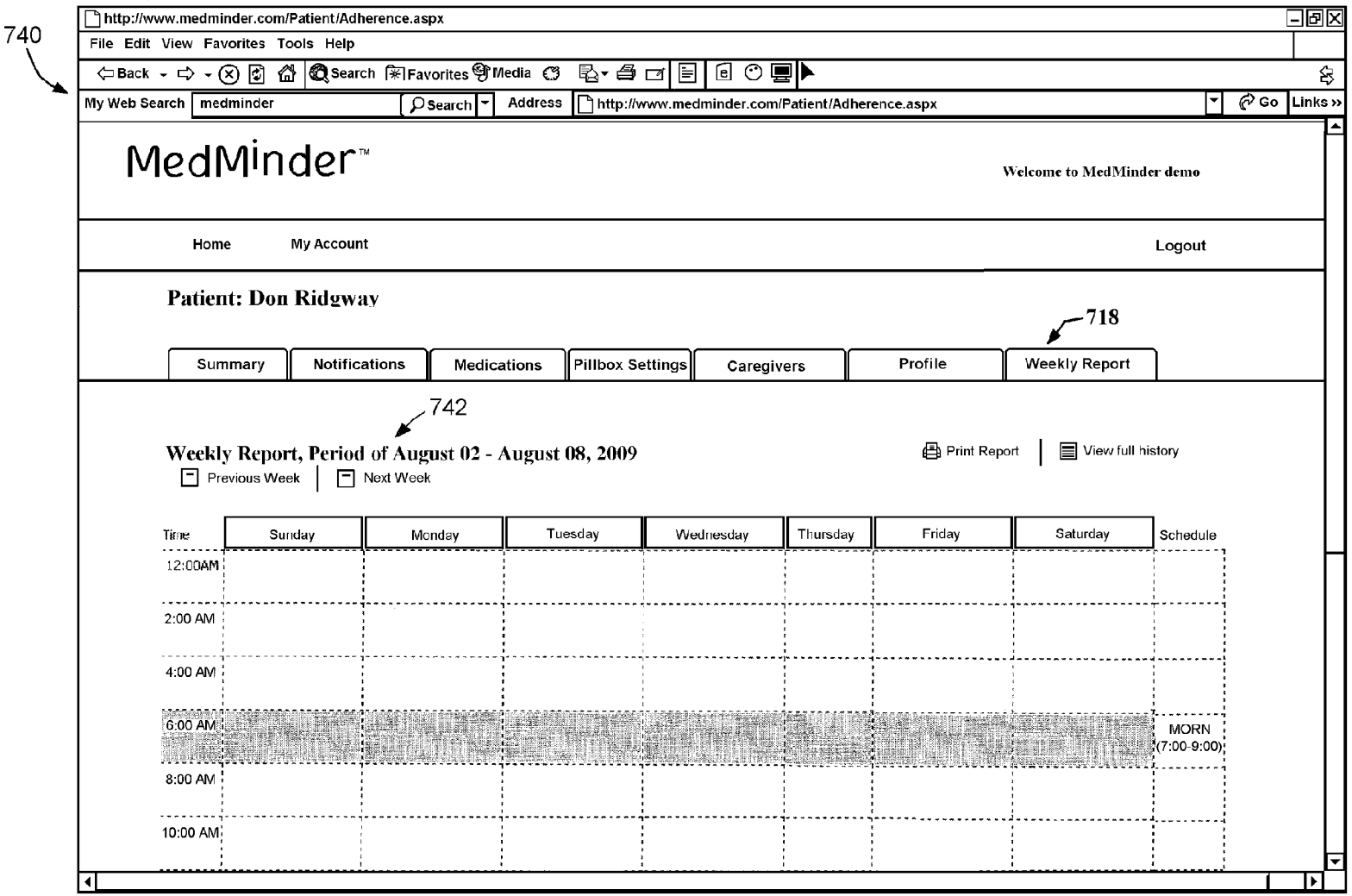
FIG. 7D depicts a weekly report filling interface of an illustrative embodiment of the managing application.

FIG. 7D shows a screenshot of a reporting interface 740 found in the above embodiment. The "Weekly Report" screen tab 718 has been selected. This screen enables the user to access information about compliance with the schedule. The schedule of compliance 742 provides a record of compliance data that is triggered by recent configuration changes at the pillbox unit. Data gathered at the central computing device can be accessed through flexible reporting capabilities on a periodic basis. In addition, this data can be exported to external systems through various methods or interfaces such as application interfaces to external systems or FTP to external computing devices.

Figure 7E:
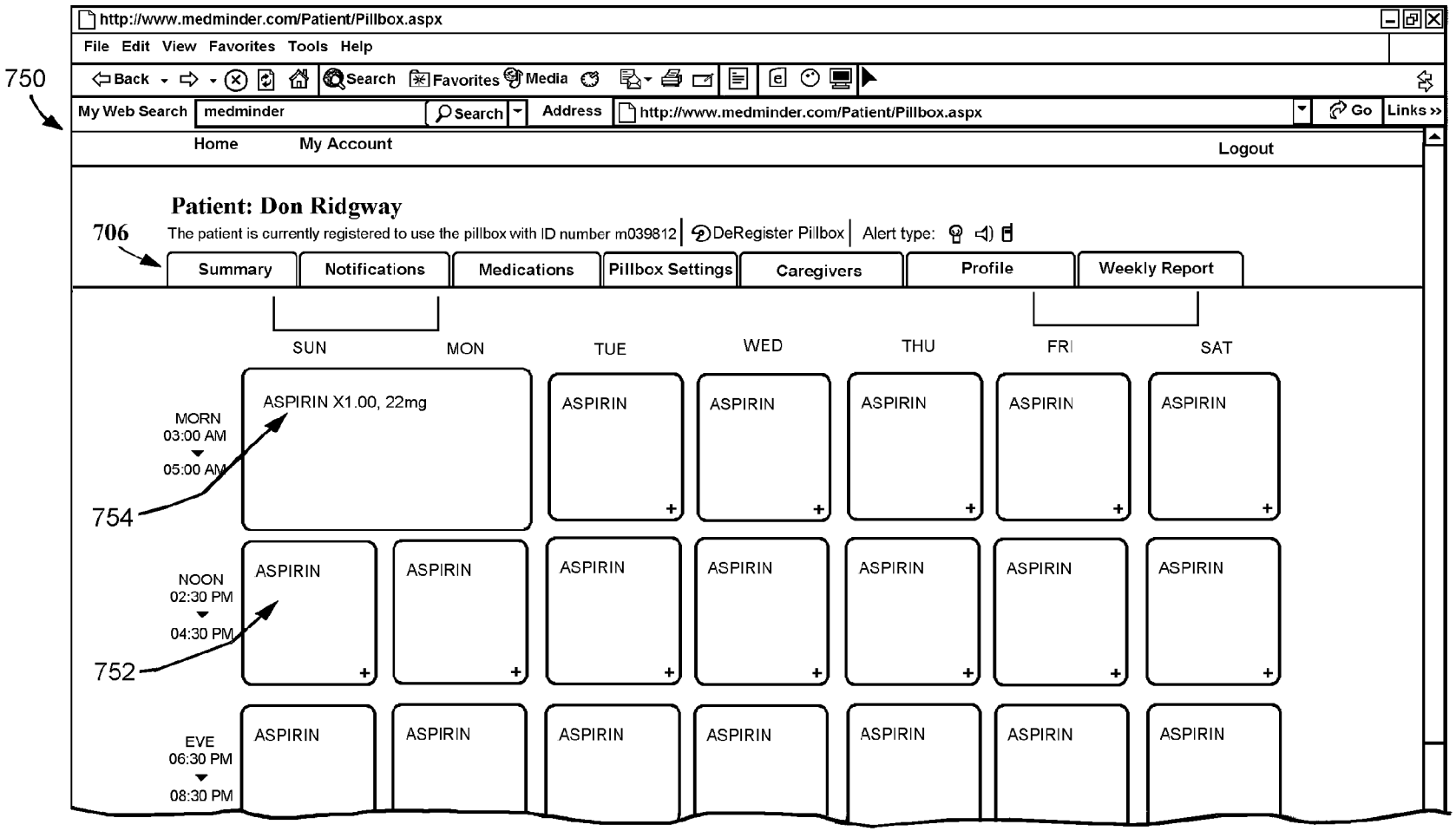
FIG. 7E depicts a compilation of medications interface of an illustrative embodiment of the managing application.

FIG. 7E shows a screenshot of a medication schedule and dose interface 750 found in the above embodiment. The "Summary" screen tab 706 has been selected. This screen presents the user with an emulative image that allows the user to virtually observe the pillbox and virtually open any of the lids 752 and review the dose and medication 754 for each scheduled dose. This screen is generated based upon the refilling agent's entry of the doses and schedule and the interactive recordation of each dosage event by the database management system.

In an alternate embodiment, the number of compartments in the medicine dispensing unit itself can be greater or lesser. The form and shape of the cups can be round in profile, square or another shape, as required, with corresponding geometry in the compartment lids. The reminding mechanisms can alternatively vary in terms of the form of the visual and auditory cues. Vibrational cues can be used. Similarly, alerting can occur in various alternate forms and medium. The unit can communicate with the manager application at the central server via various wireless or wired mechanisms. The manager application at the server can be designed to be not only a place to schedule medication and alert, but also as an educational and social hub for caregivers and family to converge, learn about and discuss being involved in the care of the user.

The foregoing has been a detailed description of the illustrative embodiments of the invention. Various modifications and additions can be made without departing from the spirit and scope of this invention. Each of the various embodiments described above can be combined with other described embodiments in order to provide multiple features. Furthermore, while the foregoing describes a number of separate embodiments of the apparatus and method of the present invention, what has been described herein is merely illustrative of the application of the principles of the present invention. For example, the size, shape, color(s), material and thickness of the cups, and the pillbox itself, described herein are highly variable. Likewise, the triggers for various changes in status by the dispensing system are highly variable. For example, the opening of the lid or detection of the presence of a user with respect to a compartment can trigger a change in system status. The systems for providing reminders and alerts, as well as the forms of the reminders and alerts, are highly variable. Likewise, it is expressly contemplated that the particular order of steps used in filling or refilling cups or refillable trays of cups can vary to accommodate various manufacturing processes and/or the needs of pharmacists or users. Accordingly, this description should be taken only by way of example, and not to otherwise limit the scope of the invention.

What is claimed is:

1. A medication dispensing system, comprising:

a body including a bottom housing and a top bezel that movably overlies and is selectively secured over the bottom housing, the bottom housing having a plurality of orifices arranged in a plurality of rows and a plurality of columns, each of the orifices being constructed and arranged to respectively receive each of a plurality of cups, wherein the cups are each sized and arranged to store a plurality of pills therein that collectively define a single dose of medication to be taken by a user at a single corresponding predetermined time, and each include a bottom, sidewalls and an open top, at least a portion of each of the cups defining a light transmissive material, wherein the top bezel includes a plurality of openings that are each respectively aligned with each of the orifices and each respectively surround each of the cups when the top bezel overlies the bottom housing, each of the openings being covered by a hinged lid that is movable by the user between a closed position that covers a respective one of the cups and an opened position that allows access by the user to, and removal of, the one of the cups from a respective one of the orifices, at least a portion of a rim of each lid defining a light-transmissive material confronting the respective one of the cups;

an illumination source located respectively within each of the orifices at a position that, when illuminated, transmits light through the respective one of the cups in a manner of a light pipe and into the portion of the rim of the lid confronting the respective one of the cups;

a sensor switch located with respect to each of the orifices that detects when the respective one of the cups is either present or absent from the respective one of the orifices so as to determine when the respective one of the cups has been removed therefrom;

a circuit located within the bottom housing that monitors each sensor switch, and that correlates the monitored state of each sensor switch with respect to a pre-programmed schedule, and provides, in response to the correlation, a signal in the form of illumination of one the illumination source with respect to the one of the orifices in which the single dose is scheduled to be taken by the user at the single corresponding predetermined time; and a network interface located at least in part in the bottom housing, operatively connected to the circuit and a communication network that delivers a status of including whether the respective one of the cups has been removed from the orifice at a time in which the illumination source located in the respective one of the orifices is illuminated.

2. The system as set forth in claim 1, wherein the signal to the user further includes at least one of transmission of a sound and generation of a cue.

3. The system as set forth in claim 1, wherein the orifices are arranged in the columns and the rows with respect to days of the week and times of day.

4. The system as set forth in claim 3, wherein each of the cups is translucent so as to transmit light into and through the cup and wherein each of the cups defines a tapered, square cross section between the bottom and top thereof, the orifices having a square orifice cross section of approximately a similar size as the square cross section of each of the cups and the orifice square cross section being constructed and arranged to receive the respective one of the cups therein.

5. The system as set forth in claim 4, wherein the lid is translucent or transparent and defines an approximately square shape, and wherein each of the cups has a height of approximately 1½ inches and top width of approximately 1 inch on each side thereof.

6. The system as set forth in claim 5, wherein the network interface is operatively connected wirelessly, to a remote server constructed and arranged to enable programming and reprogramming of a configuration that includes the pre-programmed schedule and information provided as the status.

7. The system as set forth in claim 6, wherein the server monitors the accessing of each of the cups and generates compliance data by determining the accessing by the user of each of the cups at scheduled times according to pre-programmed schedule and reports the compliance data to the remote server for access by an interested party.

8. The system as set forth in claim 7, wherein the bezel is hinged to the bottom housing and includes a latch mechanism to limit opening of the bezel with respect to the bottom housing, and the body further including a switch that monitors opening and closing of the bezel and reports the opening and the closing of the bezel as part of the status.

9. The system as set forth in claim 8, wherein the remote server is constructed and arranged to report to the recipient information related to at least one of:

(a) removal of each of the cups with respect to the configuration; or (b) replacement of each of the cups with respect to the configuration; or (c) refilling of a plurality of the cups with respect to the configuration; or (d) replacement of an entire tray composed as a plurality of cups arranged to match an arrangement of the rows and the columns of the orifices with respect to the configuration.

10. The system as set forth in claim 9, wherein the circuit is constructed and arranged to operate in illumination the illumination source located in each of the orifices in accordance with a recent programmed configuration upon a disconnection of the communication network from the remote server.

11. The system as set forth in claim 10, wherein the circuit and the remote server monitors the placement, removal and replacement of the each of the cups so as to determine a requirement for refill of medication into the cups and generates a refill reminder signal.

12. The system as set forth in claim 3 wherein the status includes transmission of predetermined information to a remote server for review by an interested party through a web-based user interface.

13. The system as set forth in claim 12 wherein the bezel defines a surface and a portion of each of the cups projects partially above the surface when located within a respective one of the orifices so as to allow grasping and removal by the user with the lid in the opened position, and wherein each lid is attached to the surface by a hinge and includes an opposing lift tab, and each hinge surrounding the partially projecting portion of the respective one of the cups with the lid rim in the closed position, in which the rim engages the surface of the bezel.

14. The system as set forth in claim 13, wherein the bezel is hinged to the bottom housing and includes a latch mechanism to limit opening of the bezel with respect to the bottom housing.

15. The system as set forth in claim 14 further comprising a replacement tray having a plurality of holes that are sized and arranged to match an arrangement of the rows and the columns of the orifices, the replacement tray having each of the cups in each of the holes with a replacement dose of the medication respectively therein, the bottom housing, the cups being removably retained in the tray and the bezel being constructed and arranged to receive the replacement tray and the cups therebetween when the bezel is hinged and latched to overlie the top housing.

16. The system as set forth in claim 15 further comprising a switch that monitors opening and closing of the bezel and reports the opening and the closing of the bezel as part of the status.

17. The system as set forth in claim 15 wherein the replacement tray includes at least one alignment feature in a perimeter thereof that matches an alignment feature formed on the body.

18. The system as set forth in claim 15 wherein the replacement tray includes a removable seal that covers the cups when each filled with the replacement dose.

19. The system as set forth in claim 15 wherein each of the rows and each of the columns includes a visible indicia of time and a visible indicia of day, respectively, on the surface of the bezel.

* * * * *